US011873643B2

(12) United States Patent
Harnish

(10) Patent No.: US 11,873,643 B2
(45) Date of Patent: Jan. 16, 2024

(54) OVERHEAD GRID ASSEMBLY, BRACKET MEMBER THEREOF, AND CEILING SYSTEM INCLUDING THE SAME

(71) Applicant: ARMSTRONG WORLD INDUSTRIES, INC., Lancaster, PA (US)

(72) Inventor: Scott D. Harnish, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 17/545,523

(22) Filed: Dec. 8, 2021

(65) Prior Publication Data

US 2022/0186494 A1 Jun. 16, 2022

Related U.S. Application Data

(60) Provisional application No. 63/124,253, filed on Dec. 11, 2020.

(51) Int. Cl.

| | |
|---|---|
| ***E04B 9/00*** | (2006.01) |
| ***E04B 9/24*** | (2006.01) |
| ***E04B 9/16*** | (2006.01) |

(52) U.S. Cl.

CPC ..... *E04B 9/003* (2013.01); *E04B 9/16* (2013.01); *E04B 9/245* (2013.01)

(58) Field of Classification Search

CPC ... E04B 9/16; E04B 9/245; E04B 9/18; E04B 9/225; E04B 9/345

See application file for complete search history.

(56) References Cited

U.S. PATENT DOCUMENTS

| | | | |
|---|---|---|---|
| 2,882,558 | A | 4/1959 | Jacobson |
| 4,438,613 | A | 3/1984 | Hintsa |
| 4,548,010 | A | 10/1985 | Hintsa |

(Continued)

FOREIGN PATENT DOCUMENTS

| | | | |
|---|---|---|---|
| DE | 1170600 | B | 5/1964 |
| EP | 0421255 | A2 | 4/1991 |

(Continued)

OTHER PUBLICATIONS

International Search Report for related International Application No. PCT/US2021/062399 dated Mar. 24, 2022.

*Primary Examiner* — Adriana Figueroa
(74) *Attorney, Agent, or Firm* — Patrick Sheldrake

(57) ABSTRACT

An overhead grid assembly for a suspended ceiling system and a bracket member thereof. The overhead grid assembly may include first and second support members having first and second longitudinal axes that are arranged in an intersecting manner to form a grid. The bracket member may include a first part having a first channel and a second part having a second channel. The bracket member is arranged to maintain the first and second support members in a desirable orientation relative to each other. Thus, a portion of the first support member may nest within the first channel and a portion of the second support member may nest within the second channel. The first and second parts of the bracket assembly may be rotatable relative to one another to ensure that the bracket assembly can be coupled to the first and second support members regardless of their relative orientation.

18 Claims, 25 Drawing Sheets

(56) References Cited

U.S. PATENT DOCUMENTS

| | | | | |
|---|---|---|---|---|
| 4,744,188 | A | 5/1988 | Ahren | |
| 5,241,799 | A | 9/1993 | Jahn | |
| 5,279,090 | A | 1/1994 | Yamaguchi | |
| 5,349,800 | A | 9/1994 | Peng | |
| 6,318,042 | B1 | 11/2001 | Bloom | |
| 6,729,096 | B1 | 5/2004 | Ashmore | |
| 6,834,467 | B2 | 12/2004 | Gulbrandsen | |
| 7,770,349 | B2 | 8/2010 | Tedesco | |
| 8,046,966 | B2 | 11/2011 | Moore | |
| 8,443,564 | B2 | 5/2013 | Bankston, Jr. | |
| 8,596,008 | B2 | 12/2013 | Waters | |
| 8,813,457 | B2 | 8/2014 | Underkofler | |
| 9,745,746 | B2 * | 8/2017 | Heesbeen | E04B 9/24 |
| 9,976,303 | B2 * | 5/2018 | Gloftis | E04B 9/183 |
| 2004/0065037 | A1 | 4/2004 | See | |
| 2008/0060306 | A1 | 3/2008 | Platt | |
| 2009/0000248 | A1 | 1/2009 | Waters | |
| 2015/0159375 | A1 | 6/2015 | Waters | |
| 2015/0211231 | A1 | 7/2015 | Bergman | |
| 2015/0233116 | A1 | 8/2015 | Mayer | |

FOREIGN PATENT DOCUMENTS

| | | | |
|---|---|---|---|
| JP | 2014-214788 | A | 11/2014 |
| KR | 10-2013-0063384 | A | 6/2013 |
| KR | 10-2118545 | B1 | 6/2020 |
| WO | WO 2007/012077 | A2 | 1/2007 |
| WO | WO 2019/050946 | A1 | 3/2019 |

* cited by examiner

OVERHEAD GRID ASSEMBLY, BRACKET MEMBER THEREOF, AND CEILING SYSTEM INCLUDING THE SAME

BACKGROUND

Suspended ceilings are used in interior spaces for several reasons. First, suspended ceilings may hide mechanical devices such as heating and cooling systems from view. Second, suspended ceilings may include acoustical panels to improve the sound quality within the interior space. Third, suspended ceilings may create a desirable aesthetic. Such suspended ceilings may include grid assemblies which include elongated support members to which the ceiling panels are attached. While some ceiling systems may require the elongated support members to be arranged in a perpendicular grid, other ceiling systems may require the elongated support members to be arranged obliquely relative to each other. Previously, different bracket members needed to be tooled and manufactured for use depending on the arrangement of the elongated support members. However, this requires maintaining several different components in inventory and fronting the costs for tooling of multiple different components. Thus, a need exists for an overhead grid assembly having a bracket member that can be used in all configurations of the elongated support members.

SUMMARY

The present invention is directed to an overhead grid assembly for a suspended ceiling system and a bracket member thereof. The overhead grid assembly may include first and second support members that are arranged in an intersecting manner to form a grid. The first support member may be elongated along a first longitudinal axis and the second support member may be elongated along a second longitudinal axis. The bracket member may include a first part having a first channel and a second part having a second channel. The bracket member is arranged to maintain the first and second support members in a desirable orientation relative to each other. Thus, a portion of the first support member may nest within the first channel and a portion of the second support member may nest within the second channel. The first and second parts of the bracket assembly may be rotatable relative to one another to ensure the bracket assembly can be coupled to the first and second support members regardless of their relative orientation In one aspect, the invention may be an overhead grid assembly for a suspended ceiling system, the overhead grid assembly comprising: a first support member comprising a first longitudinal axis; a second support member comprising a second longitudinal axis; a bracket member comprising a first part comprising a first channel and a second part comprising a second channel, wherein the bracket member is positioned so that a portion of the first support member nests within the first channel and a portion of the second support member nests within the second channel; and wherein the first and second parts of the bracket member are rotatable relative to one another to adjust an angle measured between the first and second longitudinal axes of the first and second support members.

In another aspect, the invention may be an overhead grid assembly for a suspended ceiling system, the overhead grid assembly comprising: a plurality of first support members arranged in a parallel configuration, each of the first support members comprising a first longitudinal axis; a plurality of second support members arranged in a parallel configuration, each of the second support members comprising a second longitudinal axis, the first and second support members arranged so that the first longitudinal axes of each of the first support members is oriented at a first angle relative to the second longitudinal axes of each of the second support members; a plurality of bracket members, each of the bracket members comprising a first channel comprising a first channel axis and a second channel comprising a second channel axis, wherein a portion of one of the first support members nests within the first channel and a portion of one of the second support members nests within the second channel; and wherein each of the bracket members is adjustable to modify a second angle measured between the first and second channel axes to match the second angle to the first angle.

In yet another aspect, the invention may be a bracket member for maintaining a relative position between a first support member and a second support member of an overhead grid assembly of a suspended ceiling system, the bracket member comprising: a first part comprising a first channel comprising a first channel axis; a second part comprising a second channel comprising a second channel axis; and wherein the first and second parts are rotatable relative to one another to adjust an angle measured between the first and second channel axes of the first and second channels.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The features of the exemplary embodiments of the present invention will be described with reference to the following drawings, where like elements are labeled similarly, and in which.

Figure 1:
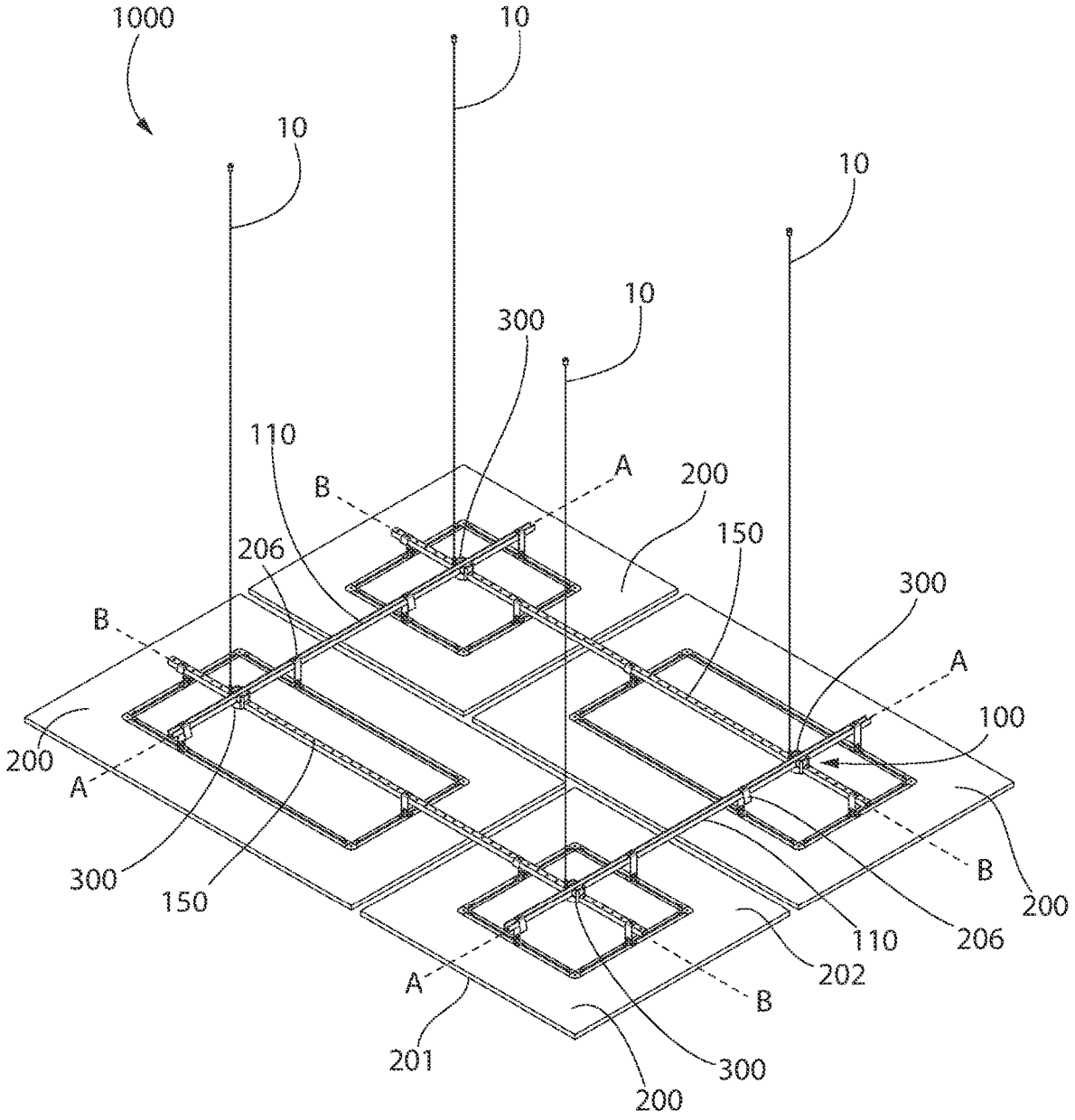
FIG. 1 is perspective view of a suspended ceiling system in accordance with an embodiment of the present invention.

All drawings are schematic and not necessarily to scale. Parts given a reference numerical designation in one figure may be considered to be the same parts where they appear in other figures without a reference numerical designation for brevity unless specifically labeled with a different part number and described herein.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Referring first to FIG. 1, a suspended ceiling system 1000 is illustrated in accordance with an embodiment of the present invention. The suspended ceiling system 1000 generally comprises an overhead grid assembly 100 and a plurality of ceiling panels 200 which are coupled to or otherwise made to hang from the overhead grid assembly 100. The overhead grid assembly 100 hangs from a structural framework such as any of various beams, joists, or the like which form a part of the building within which the suspended ceiling system 1000 is being hung. In particular, the overhead grid assembly 100 hangs from the structural framework by one or more cables or hanger wires 10 which are attached to the overhead grid assembly 100 and to the structural framework of the building. The structural framework is not illustrated in the provided figures, but its underlying structure and purpose is conventional and readily understood by those of ordinary skill in the art.

The ceiling panels 200 may be acoustic panels in that they may comprise acoustic properties to improve the sound quality in the space within which the suspended ceiling system 1000 is being used. The ceiling panels 200 may also have a desired aesthetic. For example, in FIG. 1 the ceiling panels 200 include square panels and rectangular panels that are collectively arranged in a rectangle. However, the ceiling panels 200 may have other shapes in other embodiments and they may be arranged in different overall shapes. This can be seen with a comparison of FIGS. 1 and 4, as will be described in greater detail below.

Figure 4:
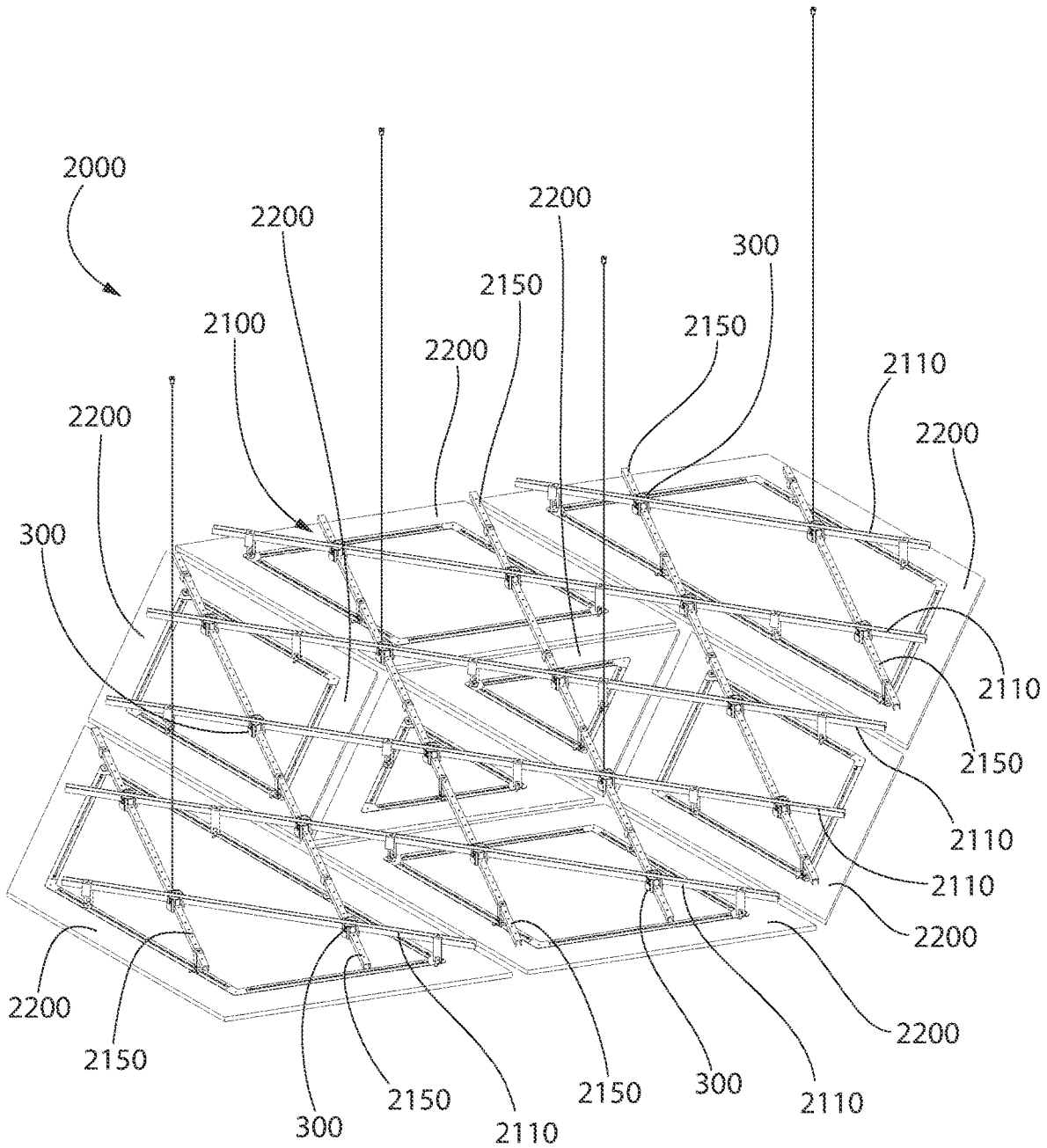
FIG. 4 is a perspective view of a suspended ceiling system in accordance with another embodiment of the present invention.

The overhead grid assembly 100 comprises support members (also known as beams, which may include main beams and cross-tee beams) which are arranged in an intersecting grid-like pattern. However, the exact arrangement of the support members of the overhead grid assembly 100 may be modified in some embodiments in order to create a desired aesthetic with the ceiling panels 200. Again, a comparison of FIG. 1 and FIG. 4 illustrates two different arrangements or intersection angles for the various support members.

Still referring to FIG. 1, the overhead grid assembly 100 comprises a plurality of first support members 110 and a plurality of second support members 150. Although only two of the first support members 110 and two of the second support members 150 are illustrated in FIG. 1, the overhead grid assembly 100 may include as many as are needed to fill the space from which the ceiling panels 200 are to be hung. Each of the plurality of first support members 110 comprises a first longitudinal axis A-A. Furthermore, the first support members 110 are arranged so that the first longitudinal axes A-A of each of the plurality of first support members 110 are oriented parallel to one another (i.e., the plurality of first support members 110 are arranged in a parallel configuration). Each of the plurality of second support members 150 comprises a second longitudinal axis B-B. Furthermore, the second support members 150 are arranged so that the second longitudinal axes B-B of each of the plurality of second support members 150 are oriented parallel to one another (i.e., the plurality of second support members 150 are arranged in a parallel configuration).

In the exemplified embodiment, each of the plurality of first support members 110 is oriented perpendicular relative to each of the plurality of second support members 150. That is, the overhead grid assembly 100 is configured so that the plurality of first support members 110 are parallel to each other and perpendicular to the plurality of second support members 150, which are also oriented parallel to one another. Thus, the plurality of first and second support members 110, 150 define a plurality of square or rectangular shaped openings with the area of intersection between the first and second support members 110, 150 forming a corner of each of the openings.

Figure 2:
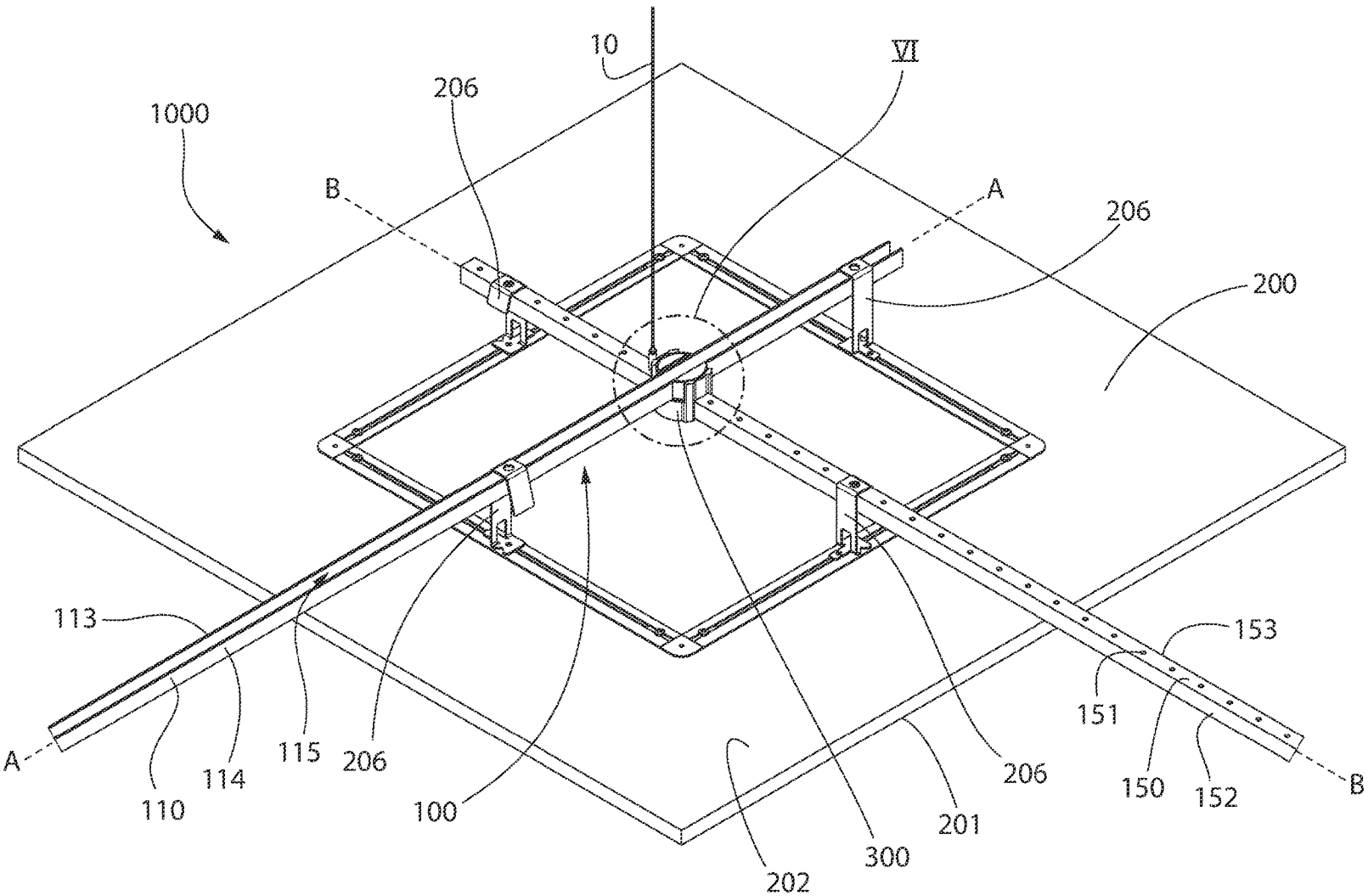
FIG. 2 is a perspective view of a portion of the suspended ceiling system of FIG. 1.

Referring to FIGS. 1 and 2, each of the plurality of second support members 150 is attached to the structural framework via the one or more hangers 10. Moreover, the plurality of first support members 110 rest atop of the second support members 150 in the intersecting arrangement noted above. In the exemplified embodiment, the plurality of first support members 110 are not directly affixed to the structural framework via the hangers 10. Rather, in the exemplified embodiment only the second support members 150 are attached to the structural framework via the hangers 10, and the first support members 110 stay in place by being positioned atop of the second support members 150 and by coupling the second support members 150 to the first support members 110. In particular, the first and second support members 110, 150 comprise holes that are aligned so that a fastener can extend through the holes to couple the first support members 110 to the second support members 150 (shown and described below with reference to FIG. 21). Only the holes 151 of the second support members 150 are visible in FIGS. 1 and 2, but it should be appreciated that the first support members 110 have identical holes in an identical arrangement in the exemplified embodiment. In fact, in the exemplified embodiment the first support members 110 and the second support members 150 are structurally identical. Of course, this need not be the case in all embodiments and the first and second support members 110, 150 may have some structural differences while still enabling them to form the overhead grid assembly 100 and support the ceiling panels 200 as described herein.

As noted above, in the exemplified embodiment the first support members 110 and the second support members 150 are structurally identical. In particular, the first and second support members 110, 150 are U-shaped members. That is, the first support members 110 comprise a floor 112 (see FIG. 11) and first and second sidewalls 113, 114 extending from the floor 112. The floor 112 and the first and second sidewalls 113, 114 collectively define an upward facing cavity 115. The second support members 150 comprise a floor 152 and first and second sidewalls 153, 154 extending from the floor 152. The floor 152 and the first and second sidewalls 153, 154 collectively define a downward facing cavity (not visible in the views provided). That is, the cavity 115 of the first support members 110 face upwardly towards the structural framework and the cavity of the second support members 150 face downwardly towards the floor of the room within which the overhead grid assembly 100 is positioned. In the exemplified embodiment, the first and second support members 110, 150 are arranged so that the outer surface of the floor 112 of the first support members 110 rest atop of the outer surface of the floor 152 of the second support members 150. Thus, the floors of the first and second support members 110, 150 face each other and the first and second sidewalls 113, 114 of the first support members 110 extend in an opposite direction than the first and second sidewalls 153, 154 of the second support members 150.

Because the first support members 110 rest atop of the second support members 150, the first and second support members 110, 150 do not intersect in a traditional sense. That is, the first support members 110 are located on a first plane and the second support members 150 are located on a second plane that is at a different elevation within the space than the first plane. The first and second planes are parallel to one another and are oriented horizontally but at different heights or elevations within the space or room. Thus, the first and second support members 110, 150 and hence also the first and second longitudinal axes A-A, B-B lie in different planes that are parallel to one another. Thus, as used herein, the term "intersect" includes two structures or axes that cross over each other even though they are at different elevations. Stated another way, the first and second support members 110, 150 in FIGS. 1 and 2 are oriented perpendicularly relative to each other despite the fact that they are positioned on different planes and therefore do not intersect in the traditional sense.

Figure 5:
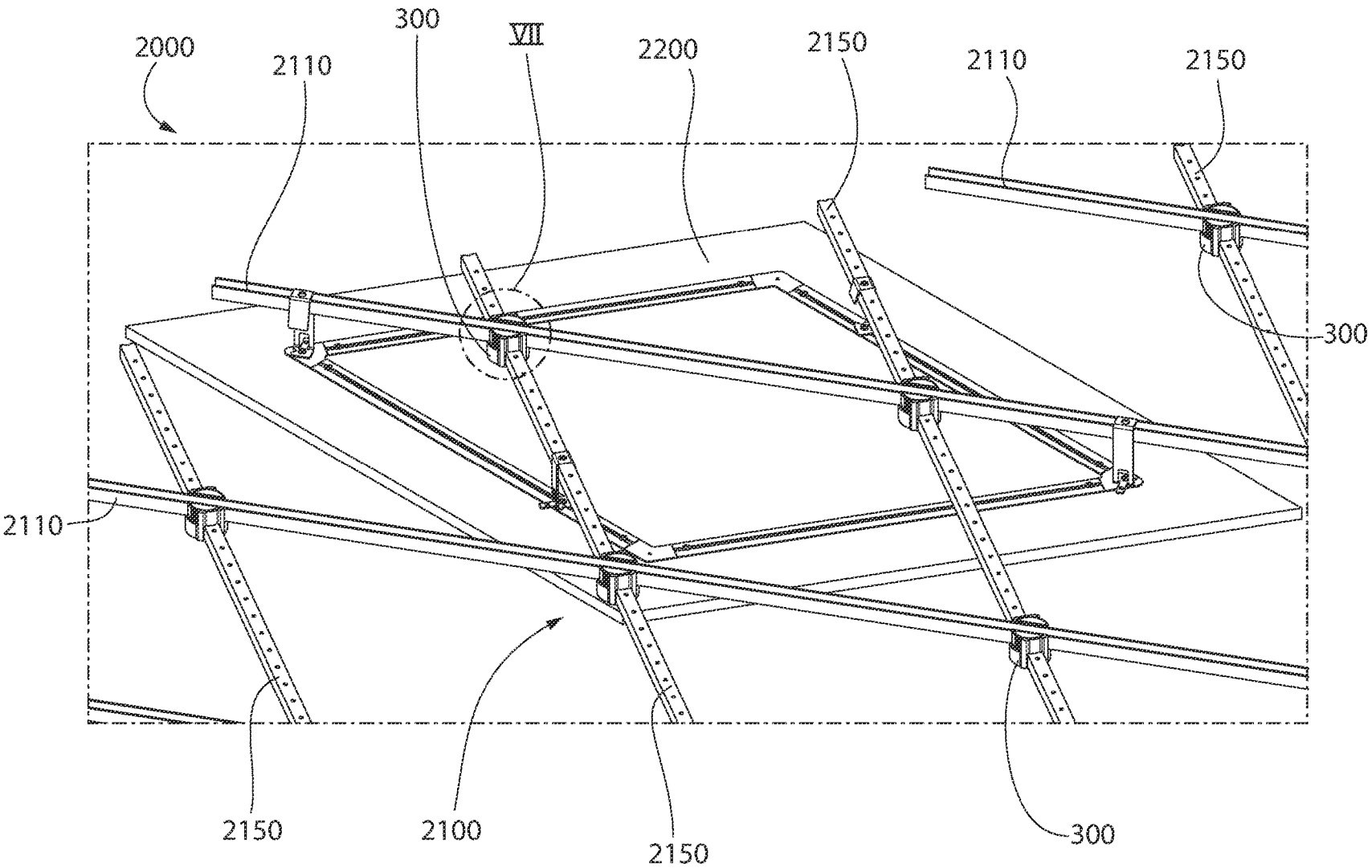
FIG. 5 is a view of a portion of the suspended ceiling system of FIG. 4.

In addition to the first and second support members 110, 150 being coupled together with a fastener that extends through the openings, the overhead grid assembly 100 also comprises bracket member 300 that is configured to maintain the first and second support members 110, 150 in a particular arrangement and at a particular relative angle. Specifically, and as described in more detail below, the bracket member 300 comprises a first channel that receives a portion of the first support members 110 and a second channel that receives a portion of the second support members 150. Thus, the bracket member 300 helps to maintain the first and second support members 110, 150 in the perpendicular arrangement shown in FIGS. 1 and 2. The bracket members 300 may also help to maintain the first and second support members 110, 150 at a different relative orientation or angle, such as that which is shown in FIGS. 4 and 5.

In particular, the bracket members 300 are capable of being modified or altered so that the same bracket members 300 can be used regardless of the desired relative orientation at which the first and second support members 110, 150 are to be positioned. Previously, different bracket members were needed depending on the orientation of the first support members 110 relative to the second support members 150. Such previous bracket members were fixed and not alterable so that the same bracket members were not able to be used with the first and second support members 110, 150 positioned in a perpendicular orientation relative to each other (see FIG. 1) and/or at an oblique orientation relative to each other (see FIG. 4). The bracket members 300 described herein can be used regardless of the relative orientation between the first and second support members 110, 150 thereby negating any need for having multiple different types of the bracket members in inventory at any given time. The bracket members 300 will be described in greater detail below.

Figure 3:
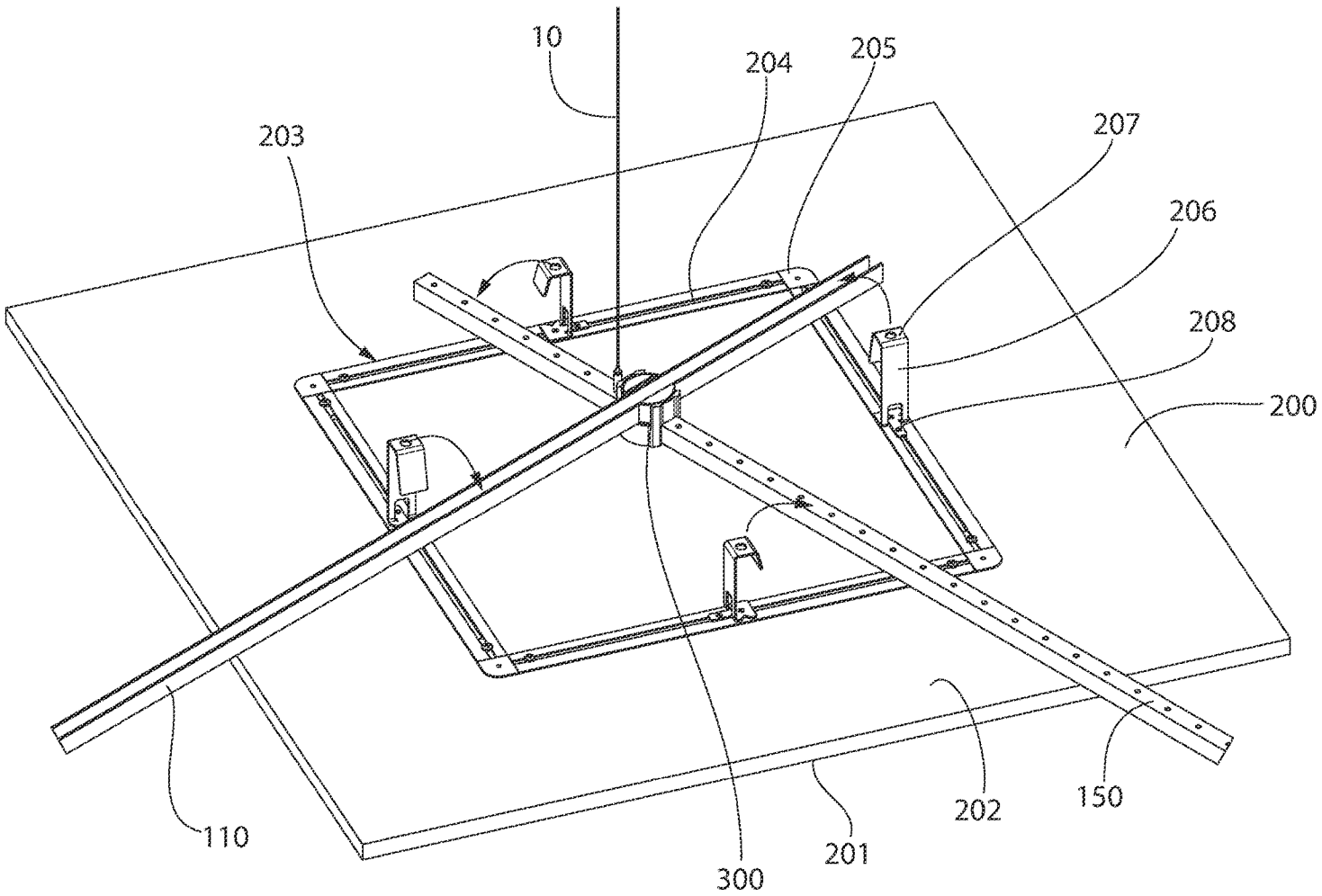
FIG. 3 is a perspective view of the portion of the suspended ceiling system of FIG. 2, illustrating the process by which a ceiling panel thereof is coupled to an overhead grid assembly thereof.

Referring to FIGS. 1-3, the ceiling panels 200 comprise a front surface 201 which is exposed to the interior space or room and a rear surface 202 opposite the front surface 201. The rear surface 202 of the ceiling panels 200 faces the overhead grid assembly 100 when the ceiling panels 20 are installed thereon. The front surfaces 201 of the ceiling panels 200 are hardly visible in the provided views, but the front surfaces 201 are the surfaces which are visible to a user standing in the room within which the suspended ceiling system 1000 is positioned. The rear surfaces 202 of the ceiling panels 200 comprise one or more grooves or channels 203 formed therein. One or more coupling bars 204 are secured in the channels 203 by corner brackets 205. Furthermore, a plurality of hook members 206 are affixed to the ceiling panels 200 within the channels 203 due to engagement with the one or more coupling bars 204. Specifically, the hook members 206 comprise coupling portions 208 which engage the coupling bars 204 to couple the hook members 206 to the ceiling panels 200. The hook members 206 may be secured to the coupling bars 204 using fasteners such as screws, bolts, nuts, or the like.

The hook members 206 also comprise hook portions 207 which are used to attach the ceiling panels 200 to the overhead grid assembly 100. In particular, in the exemplified embodiment the hook portions 207 all face the same direction. Thus, as shown in FIG. 3, the ceiling panels 200 are attached to the overhead grid assembly 100 by aligning the hook portions 207 of the hook members 206 with one of each of the first and second support members 110, 150 and then rotating the ceiling panel 200 until the hook portions 207 engage the first and second support members 110, 150 (as best shown in FIG. 3). As noted above, the first support members 110 are held at a higher elevation than the second support members 150. Thus, the hook members 206 may have different heights depending on whether they are configured to engage one of the first support members 110 or one of the second support members 150. That is, the hook members 206 that are intended to engage the first support members 110 may be taller than those that are intended to engage the second support members 150. Once all of the hook members 206 of a given ceiling panel 200 are engaged with one of the first support members 110 or one of the second support members 150, the ceiling panel 200 is sufficiently supported by the overhead grid assembly 100 as shown in FIGS. 1 and 2.

Referring to FIGS. 4 and 5, a suspended ceiling system 2000 is illustrated in accordance with another embodiment of the present invention. The suspended ceiling system 2000 is very similar to the suspended ceiling system 1000, and thus only the features of the suspended ceiling system 2000 which differ from the suspended ceiling system 1000 will be described below. It should be apparent that the description of the suspended ceiling system 1000 provided above is applicable to all other features and concepts of the suspended ceiling system 2000 as readily understood by viewing the drawings.

The suspended ceiling system 2000 comprises an overhead grid assembly 2100 and a plurality of ceiling panels 2200. The overhead grid assembly 2100 comprises a plurality of first support members 2110 that are arranged in a parallel configuration and a plurality of second support members 2150 that are arranged in a parallel configuration. However, in this embodiment the plurality of first support members 2110 are not oriented perpendicular to the plurality of second support members 2150. Rather, the plurality of first support members 2110 are oriented at an oblique angle relative to the plurality of second support members 2150. Thus, in this embodiment the openings formed by the first and second support members 2110, 2150 are in the shape of a rhombus. This different arrangement of the first and second support members 2110, 2150 (as compared to the arrangement of the first and second support members 110, 150 previously described) may allow for differently shaped ceiling panels to be attached thereto. Thus, as shown in FIGS. 4 and 5, the ceiling panels 200 may have rhombus shapes, trapezoidal shapes, square shapes, triangular shapes, or the like. Such differently shaped ceiling panels 200 cannot be readily and easily attached to the overhead grid assembly 100 which includes perpendicularly oriented support structures 110, 150. Thus, by modifying the relative positioning of the first and second support members 2110, 2150, the ceiling panels 2200 may individually and collectively define different shapes, thereby creating a different aesthetic. Such different shapes may also be needed depending on the overall shape of the space within which the suspended ceiling system 2000 is being used.

As noted above, the same bracket members 300 that are used with the overhead grid assembly 100 can also be used with the overhead grid assembly 2100. That is, because the channels of the bracket members 300 can be adjusted relative to one another in terms of their relative positioning or angle, the same bracket members 300 can be used to secure the first and second support members 110, 150 of the overhead grid assembly 100 together in the perpendicular arrangement and to secure the first and second support members 2110, 2150 of the overhead grid assembly 2100 together in the oblique arrangement.

Figure 6:
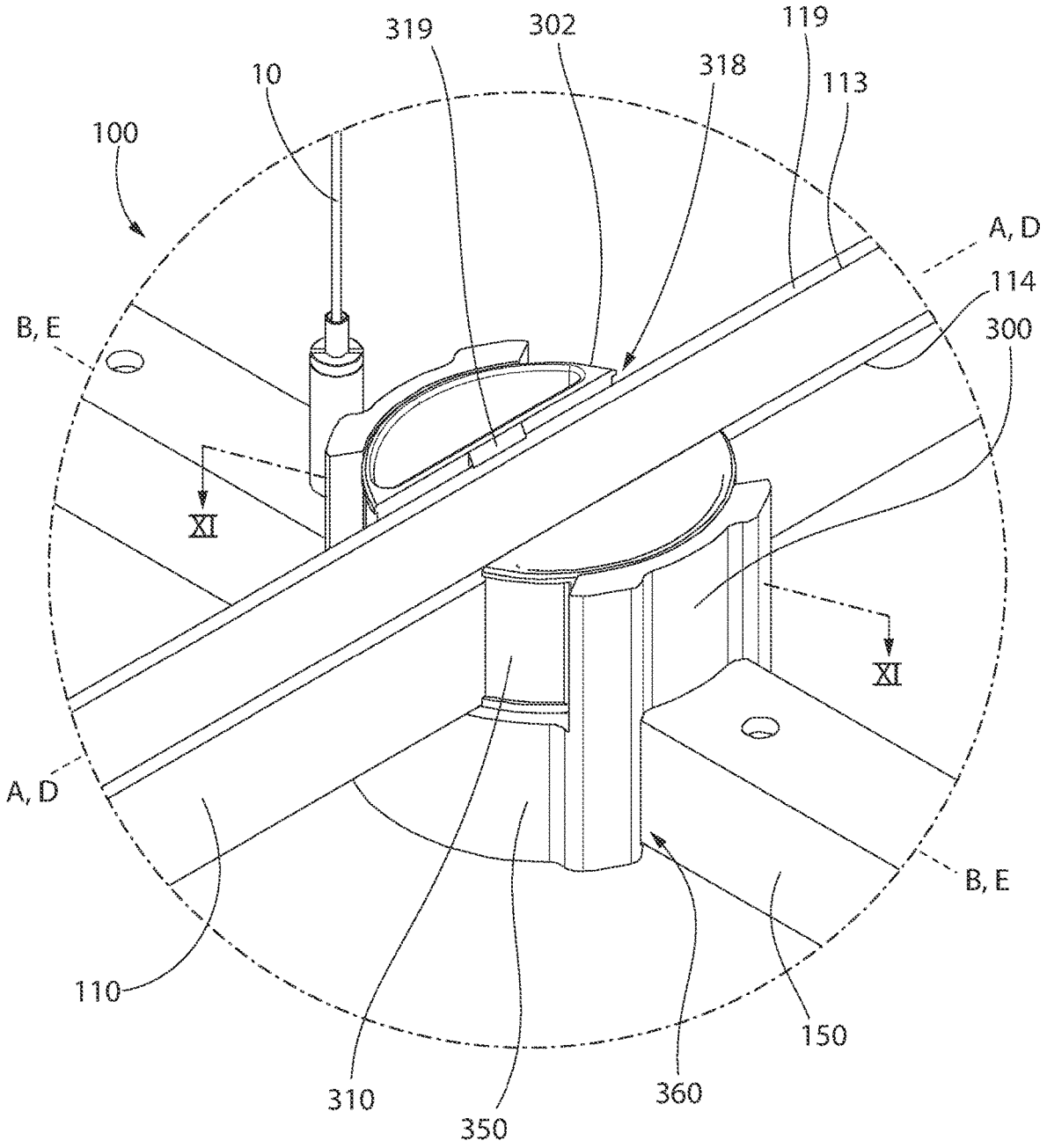
FIG. 6 is a close-up view of area VI of FIG. 2.
Figure 7:
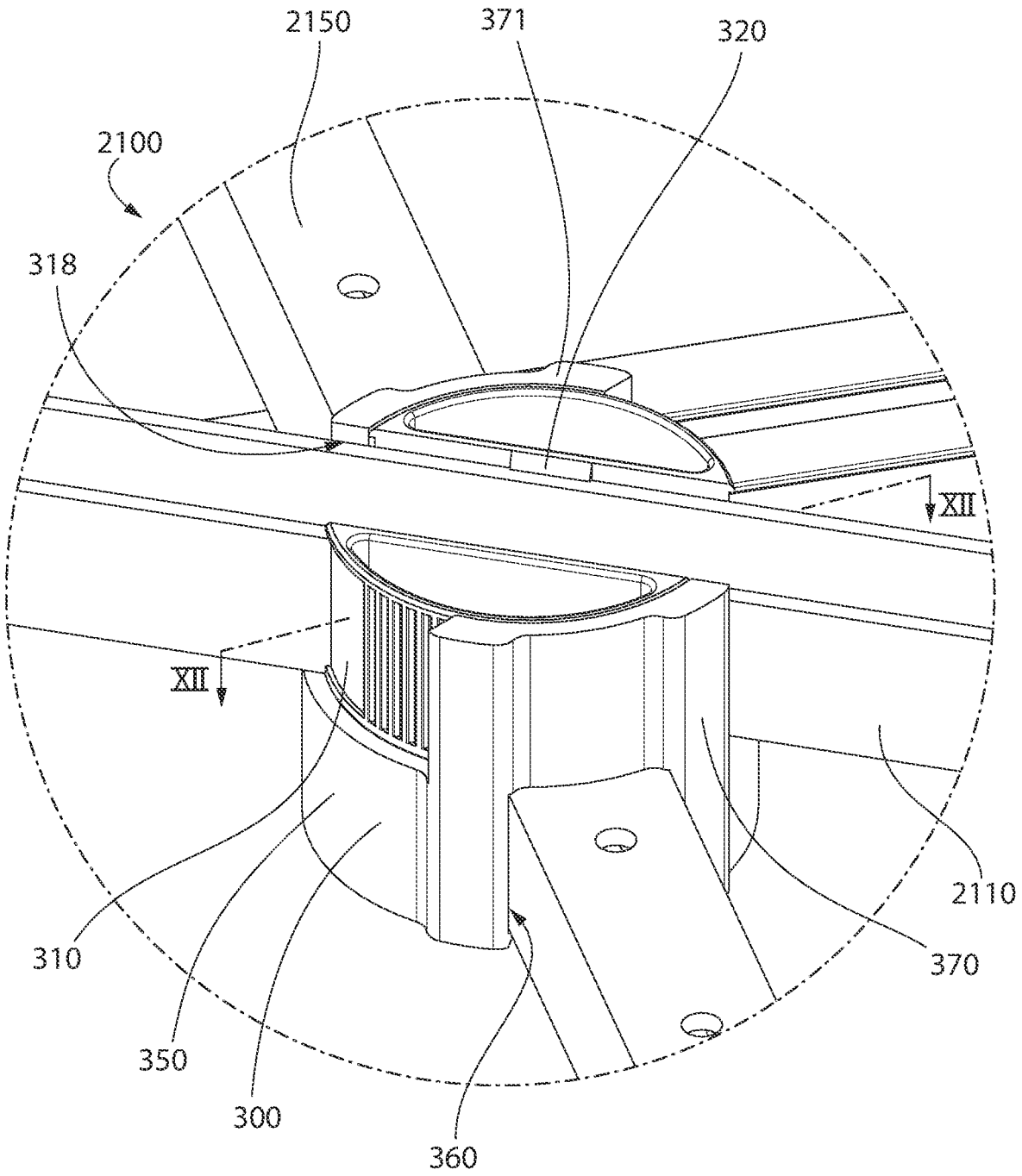
FIG. 7 is a close-up view of area VII of FIG. 5

Referring to FIGS. 6 and 7, the bracket member 300 is illustrated being used with the different overhead grid assemblies 100, 2100 described above. In particular, FIG. 6 is a close-up view of one of the bracket members 300 being used with the first and second support members 110, 150 of the overhead grid assembly 100 and FIG. 7 is a close-up view of one of the bracket members 300 being used with the first and second support members 2110, 2150 of the overhead grid assembly 2100. Thus, FIGS. 6 and 7 collectively show how the same bracket member 300 can be modified for use with the first and second support members 110, 150 arranged in a perpendicular configuration and with the first and second support members 2110, 2150 arranged in an oblique configuration. This is an improvement over conventional systems whereby completely different bracket members would have been needed for the first overhead grid assembly 100 and for the second overhead grid assembly 2100.

Figure 8:
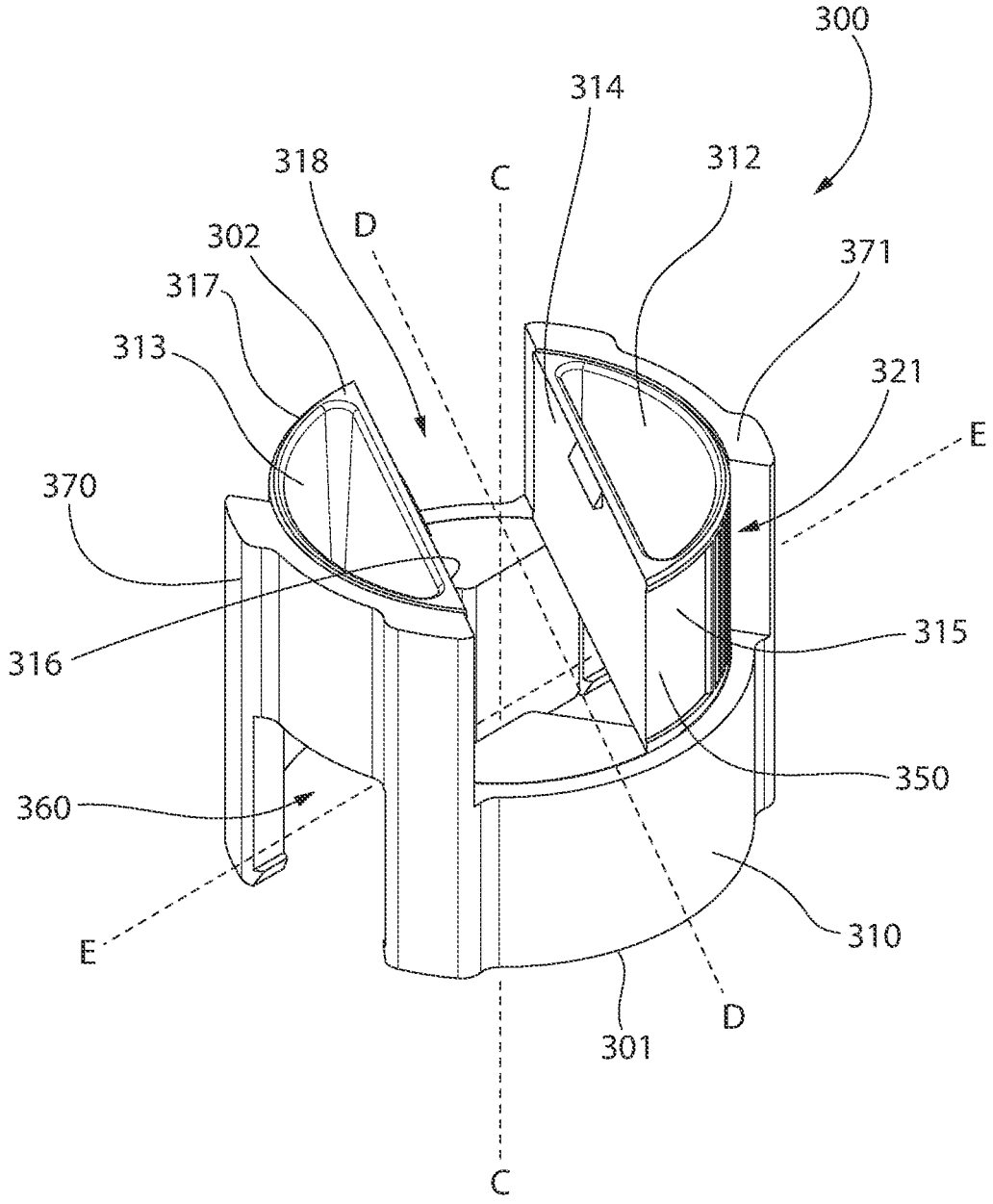
FIG. 8 is a perspective view of a bracket assembly of the suspended ceiling system of FIG. 1 in accordance with a first embodiment of the present invention.
Figure 9:
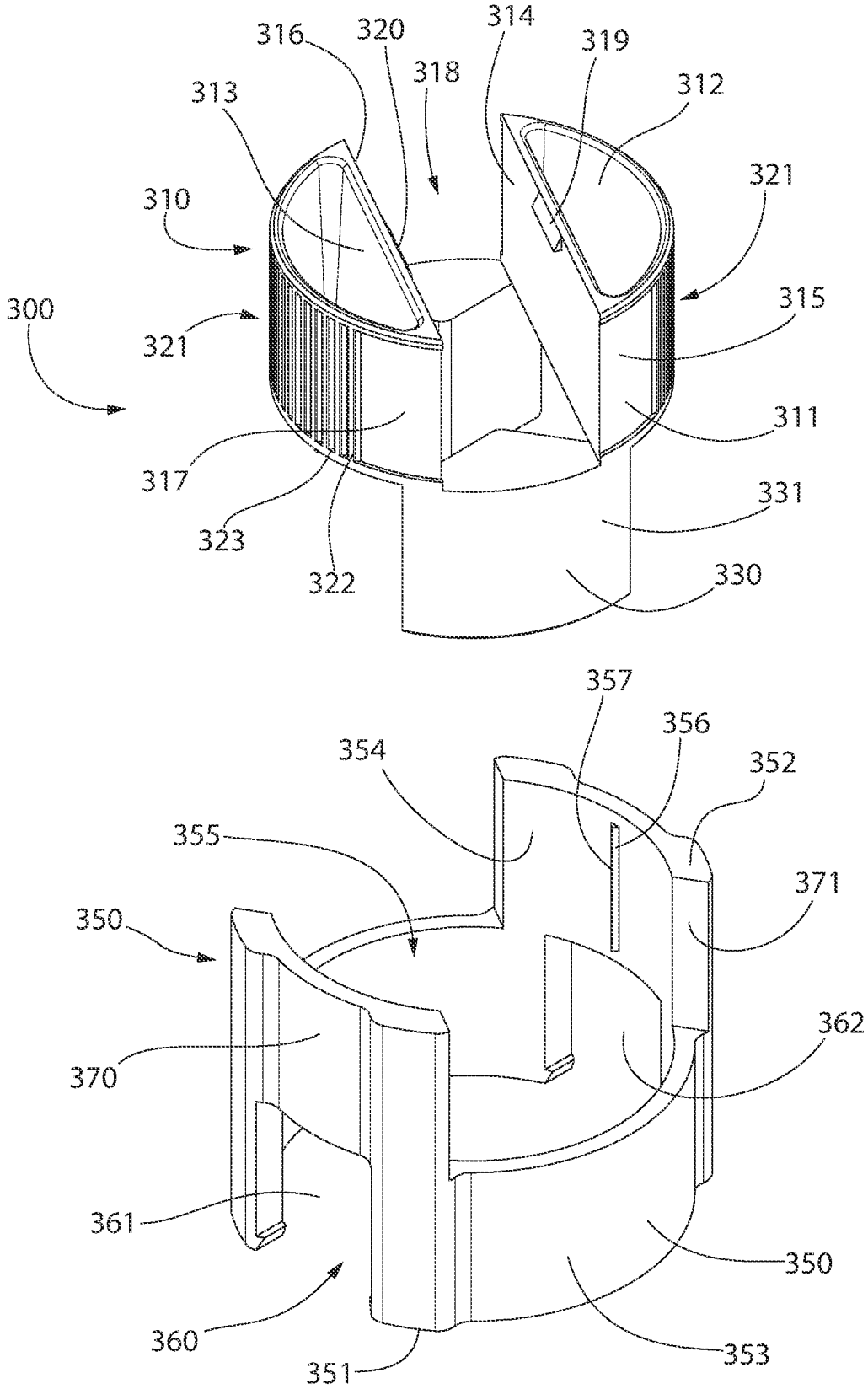
FIG. 9 is a top perspective view of the bracket assembly of FIG. 8 in a disassembled configuration.
Figure 10:
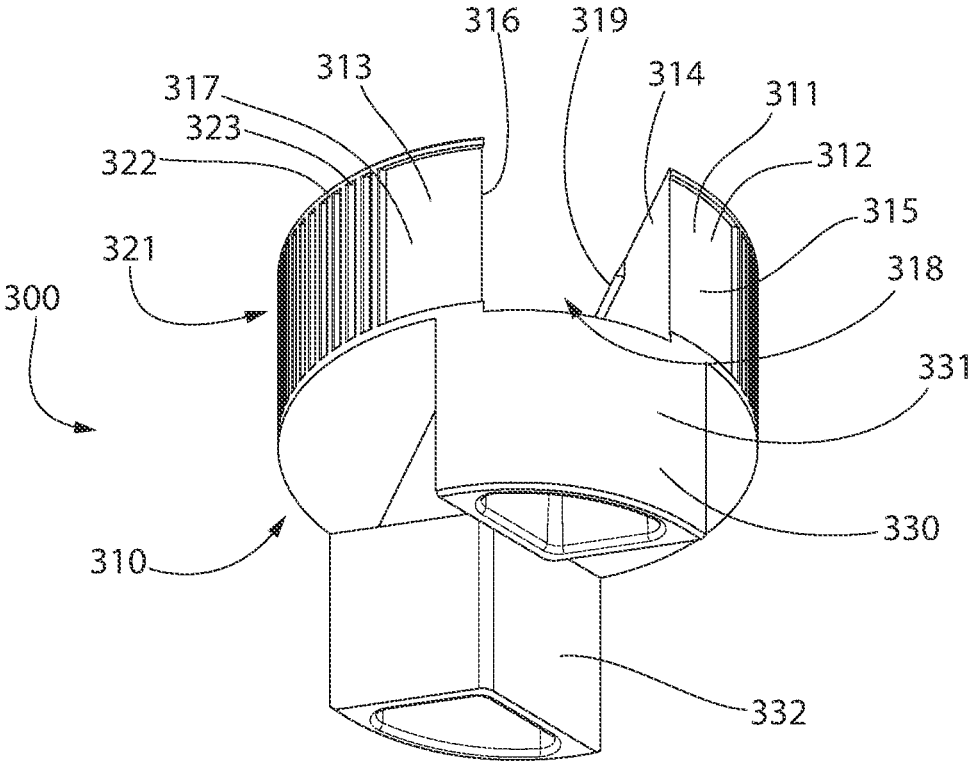
FIG. 10 is a bottom perspective view of the bracket assembly of FIG. 8 in the disassembled configuration.
Figure 10:
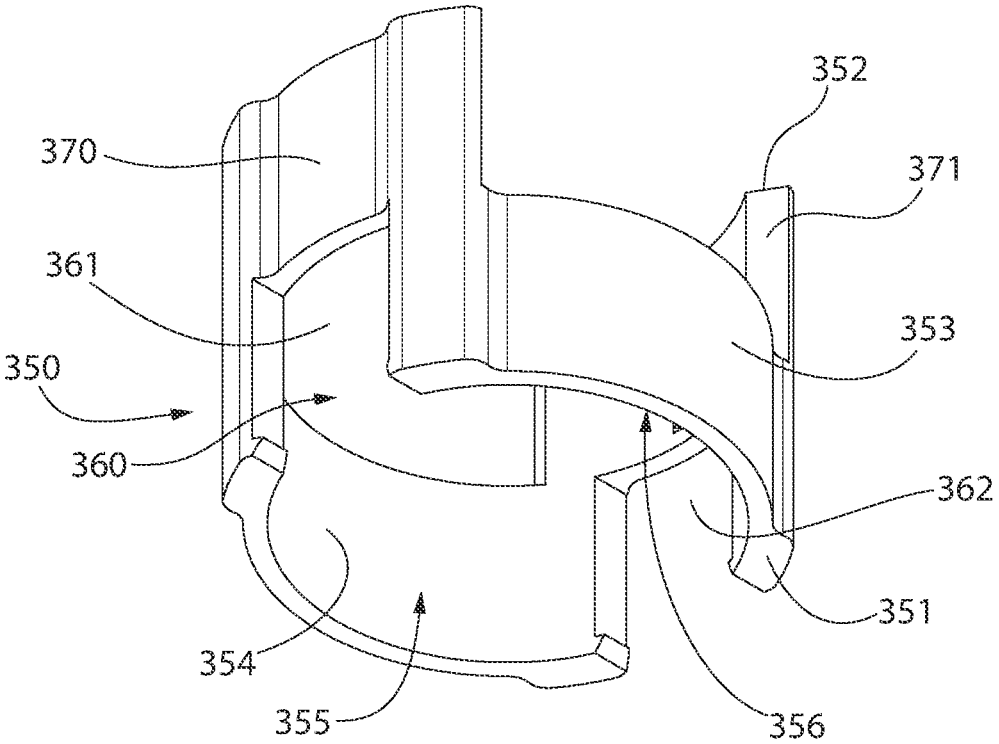

Referring to FIGS. 8-10, the bracket member 300 will be described in detail. The bracket member 300 comprises a first part 310 and a second part 350 that cooperate to render the bracket member 300 adjustable as described herein. The first and second parts 310, 350 are distinct components of the bracket member 300 such that the first and second parts 310, 350 can be readily detached from one another and maintained as separate components. Because the first and second parts 310, 350 are distinct components, they are configured to rotated relative to one another when assembled. In the exemplified embodiment, when the bracket member 300 is assembled one of the first and second parts 310, 350 nests within a cavity of the other one of the first and second parts 310, 350, but the first and second parts 310, 350 are not physically coupled together. This enables the first part 310 to rotate relative to the second part 350 even when the bracket member 300 is assembled with the first part nesting within a cavity of the second part 350. The first and second parts 310, 350 of the bracket member 300 may be made from plastic in some embodiments (i.e., injection molded). However, the invention is not to be so limited in all embodiments and other materials may be used, including wood, metal, composites, or the like.

The bracket member 300 comprises a bottom end 301 which is formed by the bottom of the first part 310, a top end 302 which is formed by a top of the second part 350, and a longitudinal axis C-C which extends in a direction from the bottom end 301 to the top end 302. When the bracket member 300 is assembled, the first and second parts 310, 350 thereof are rotatable relative to each other, which facilitates the ability of the bracket member 300 to be used with various overhead grid assemblies whereby the support members thereof are arranged at different relative orientations. The longitudinal axis C-C also forms a rotational axis of the bracket member 300 such that the first part 310 is rotatable relative to the second part 350 about the rotational axis C-C (or the second part 350 may be rotatable relative to the first part 310 about the rotational axis C-C).

The first part 310 of the bracket member 300 comprises an upper portion 311 and a lower portion 330. The upper portion 311 comprises a first hemispherical portion 312 and a second hemispherical portion 313 that are arranged in a spaced apart manner. Although the term "hemispherical" is used to describe the shapes of the first and second hemispherical portions 312, 313, it should be appreciated that in the exemplified embodiment they have flat top and bottom surfaces and are therefore not pure hemisphere shapes. Rather, in the exemplified embodiment he first and second hemispherical portions 312, 313 are in the shape of the letter D and have a thickness or height.

The first hemispherical portion 312 comprises an inner surface 314 and an outer surface 315, and the second hemispherical portion 313 comprises an inner surface 316 and an outer surface 317. The inner surfaces 314, 316 of the first and second hemispherical portions 312, 314 of the upper portion 311 of the first part 310 of the bracket member 300 face each other in a spaced apart manner so that a first channel 318 of the bracket member 300 is defined between the inner surfaces 314, 315 of the first and second hemispherical portions 312, 314. Thus, the first part 310 of the bracket member 300 comprises the first channel 318 in the exemplified embodiment. In the exemplified embodiment, the inner surfaces 314, 316 of the first and second hemispherical portions 312, 314 are planar surfaces that extend vertically and parallel to one another. This ensures that the inner surfaces 314, 316 of the first and second hemispherical portions 312, 314 abut against the outer surfaces of the first and second sidewalls 113, 114 of the first support members 100 when the bracket members 300 are coupled thereto as described herein. However, the inner surfaces 314, 316 need not be smooth and completely flat surfaces in all embodiments and they could include undulations, depressions, protrusions, or other features in other embodiments. Moreover, the inner surfaces 314, 316 may be inclined or angled rather than vertical in some embodiments.

Additionally, the first hemispherical portion 312 comprises a first locking tab 319 protruding from the inner surface 314 into the first channel 318 adjacent to the top end of the first part 310. The second hemispherical portion 314 comprises a second locking tab 320 protruding from the inner surface 316 into the first channel 318 adjacent to the top end of the first part 310. As shown in FIGS. 6 and 7, the first and second locking tabs 319 form snap-lock features that secure the bracket member 300 to the overhead grid assembly 100, 2100. In particular, the top edge of the first support members 110, 2110 are positioned just below and in abutting contact with a lower surface of the first and second locking tabs 319, 320 to prevent disengagement between the first support members 110, 2110 and the bracket member 300.

In the exemplified embodiment, the outer surfaces 315, 317 of the first and second hemispherical portions 312, 314 of the first part 310 of the bracket member 300 are convex in shape (they each form part of a circle). This round/arcuate shape of the outer surfaces 315, 317 enables the first part 310 of the bracket member 300 to rotate relative to the second part 350 of the bracket member 300, as will be described in greater detail below. The outer surfaces 315, 317 of the first and second hemispherical portions 312, 314 of the first part 310 of the bracket member 300 comprise a first engagement feature 321. In the exemplified embodiment, the first engagement feature 321 comprises a plurality of first teeth 322 (or vertical ridges) extending from the outer surfaces 315, 317 of the first and second hemispherical portions 312, 314. Each of the first teeth 322 extends along a majority or entirety of a height of the first and second hemispherical portions 312, 314 of the first part in the exemplified embodiment, although they could have a reduced height in other embodiments. Each pair of adjacent ones of the first teeth 322 are spaced apart by a groove 323. In the exemplified embodiment, each of the first teeth 322 has a triangular shaped cross-section and the grooves 323 between adjacent ones of the first teeth 322 are also triangular-shaped. This enables the first engagement feature 321 (i.e., the plurality of first teeth 322 and grooves 323) to interact with a similarly shaped protuberance on the second part 350 of the bracket member 300 as described in greater detail below.

As noted above, the first part 310 of the bracket member 300 comprises the lower portion 330 in addition to the upper portion 311. In the exemplified embodiment, the lower portion 330 of the bracket member 300 comprises a first post 331 and a second post 332 which extend downwardly from the upper portion 311 to a bottom end of the first part 310. The first and second posts 331, 332 are spaced apart from one another as best seen in FIG. 10.

The second part 350 of the bracket member 300 comprises a bottom end 351 which forms at least a portion of the bottom end 301 of the bracket member 300 when assembled and a top end 352 opposite the bottom end 351. The second part 350 of the bracket member 300 further comprises an outer surface 353 and an inner surface 354. The inner surface 354 defines a cavity 355 within which at least a portion of the first part 310 of the bracket member 300 nests when the bracket member 300 is assembled as shown in FIG. 8. In the exemplified embodiment, the second part 350 of the bracket member 300 has a round/circular shape with the inner surface 354 being concave and the outer surface 353 being convex. Thus, the second part 350 of the bracket member 300 is a generally ring-shaped component with additional features as noted below.

The second part 350 of the bracket member 300 comprises an engagement feature 356 that protrudes from the inner surface 354 thereof inwardly towards the cavity 355. In the exemplified embodiment, the engagement feature 356 is a singular protuberance or ridge 357 that is elongated in a vertical direction. Furthermore, the protuberance or ridge 357 has a triangular shape similar to the teeth and grooves 322, 323 of the engagement feature 321 of the first part 310 of the bracket member 300. The engagement feature 356 on the inner surface 354 of the second part 350 of the bracket member 300 is configured to mate with the engagement feature 321 on the outer surface 315, 317 of the upper portion 311 of the first part 310 of the bracket member 300 to prevent the first and second parts 310, 350 from freely rotating relative to each other. It should be appreciated that while the first and second engagement features 321, 356 are desirable in some embodiments, they are not required and could be omitted in some alternative embodiments.

The second part 350 of the bracket member 300 comprises a second channel 360. In the exemplified embodiment, the second channel 360 is defined by a first opening 361 that extends through the second part 350 of the bracket member 300 from the outer surface 353 to the inner surface 354 and a second opening 362 that extends through the second part 350 of the bracket member 300 from the outer surface 353 to the inner surface 354. The first and second openings 361, 362 extend from the bottom end 351 of the second part 350 upwardly towards the top end 352 of the second part 350, although the first and second openings 361, 362 do not extend the full height of the second part 350. The first and second openings 361, 362, in combination with a portion of the cavity 355 of the second part 350 which spans between the first and second openings 361, 362, collectively forms the second channel 360. A portion of one of the support members 110, 150 can enter into the second channel 360 by lowering the second part 350 thereon so that the support member 110, 150 enters into the second channel 360 from the bottom end 351 of the second part 350.

FIG. 8 illustrates the bracket member 300 in an assembled state with the first and second parts 310, 350 coupled together. When assembled, the first part 310 of the bracket member 300 nests within the cavity 355 of the second part 350 of the bracket member 300. Furthermore, the first part 310 is configured to rotate relative to the second part 350 about a rotational axis (with the rotational axis being the same as the longitudinal axis C-C). Furthermore, as can be seen in FIG. 8, the first channel 318 of the bracket member 300 which is defined by the first part 310 thereof extends along a first channel axis D-D. Furthermore, the second channel 360 of the bracket member 300 which is defined by the second part 350 thereof extends along a second channel axis E-E. Each of the first and second channel axes D-D, E-E is perpendicular to the longitudinal or rotational axis C-C of the bracket member 300. Furthermore, because the first part 310 is capable of rotating within the cavity 355 of the second part 350 relative to the second part 350, the angle of orientation between the first and second channel axes D-D, E-E is not a fixed angle. Rather, the angle between the first and second channel axes D-D, E-E is changed as the first part 310 rotates relative to the second part 350. In some embodiments, the first and second parts 310, 350 of the bracket member 300 may be configured to rotate relative to one another to modify an angle measured between the first and second channel axes D-D, E-E within a range of at least 60° to 120°.

As mentioned above, in the exemplified embodiment the first and second parts 310, 350 are prevented from freely rotating relative to each other due to the interaction between the first and second engagement features 321, 356. In particular, when the first part 310 nests within the cavity 355 of the second part 350, the second engagement feature 356 of the second part 350 mates with the first engagement feature 321 of the first part 310. In the exemplified embodiment, this means that the protuberance 357 of the second engagement feature 356 nests within the spaces 323 between adjacent ones of the teeth 322 of the first engagement feature 321, much like a ratchet mechanism. Thus, as the first part 310 is rotated relative to the second part 350, the protuberance 357 of the second engagement feature 356 moves along the teeth 322 of the first engagement feature 321 one at a time, making n audible clicking sound with each movement. In some embodiments, each ratcheting movement of the first part 310 relative to the second part 350 (i.e., each movement which causes the protuberance 357 to move from one groove 323 between two adjacent teeth 322 to an adjacent space 323 between two teeth 322) results in a 5° rotation of the first part 310 relative to the second part 350.

Referring again to FIG. 6, the bracket member 300 is illustrated being used with the overhead grid assembly 100 of FIGS. 1-3, whereby the first and second support members 110, 150 of the overhead grid assembly 100 are oriented perpendicular to one another. Thus, when used in this manner, the first and second channel axes D-D, E-E are oriented perpendicularly to each other. In particular, the bracket member 300 is positioned so that a portion of the first support member 110 nests within the first channel 318 defined by the first part 310 of the bracket member 300 and the second support member 150 nests within the second channel 360 defined by the second part 350 of the bracket member 300. More specifically, in this embodiment an entirety of the first support member 110 nests within the first channel 318 defined by the first part 310 of the bracket member 300. Moreover, a top edge 119 of the first support member 110 is recessed below the top end 302 of the bracket member 300. As a result, the first and second locking tabs 319, 320 engage the top edge 119 (or distal end) of the first and second sidewalls 113, 114 of the first support member 110 to retain the first support member 110 within the first channel 318. As can be appreciated, the first and/or second hemispherical portions 312, 313 need to be flexed outwardly away from one another in order to disengage the first and second locking tabs 319, 320 from the first support member 110 so that the first support member 110 can be removed from the first channel 318 of the first part 310 of the bracket member 300.

At the same time, the second support member 150 nests within the second channel 360 of the bracket member 300 which is defined by the second part 350 of the bracket member 300. The second support member 150 nests within the second channel 360 and protrudes through the first and second openings 361, 362 of the second channel 360. Thus, typically when assembling the overhead grid assembly 100, first the bracket assembly 300 is positioned over the second support member 150 so that the second support member 150 is made to nest within the second channel 360. Once the bracket member 300 is positioned over the second support member 150, the first support member 110 is placed over top of the second support member 150 and over top of the bracket member 300 to nest a portion of the first support member 110 within the first channel 318 of the bracket member 300. The first part 310 of the bracket member 300 may be rotated relative to the second part 350 of the bracket member 300 either before or after the first support member 110 is positioned within the first channel 318.

As seen in FIG. 6, a portion of the bracket member 300 wraps around each of the first and second support members 110, 150 to hold them in place and in the desired relative orientation. Furthermore, the second support member 150 is coupled to the structural framework by the cable 10, the bracket member 300 rests atop of the second support member 150, and then the first support member 110 rests atop of the second support member 150 and atop of a portion of the bracket member 300. The first and second support members 110, 150 may be securely coupled together with a fastener extending through the holes formed through the first and second support members 110, 150 as described above.

Referring to FIG. 7, the same bracket member 300 is being used with the overhead grid assembly 2100 whereby the first and second support members 2110, 2150 are oriented at an oblique angle relative to one another. In particular, the first support member 2110 nests within the first channel 318 and the second support member 2150 nests within the second channel 360. However, in this embodiment the first and second channels 318, 360 (and hence also the first and second support members 2110, 2150) are not oriented perpendicularly relative to one another. Rather, the first part 310 of the bracket member 300 has been rotated relative to the second part 350 of the bracket member 300 so that the first and second channels 318, 360 can accommodate the first and second support members 2210, 2150 which are arranged in a non-perpendicular orientation.

Referring to FIGS. 7-10, the second part 350 of the bracket member 300 comprises a first and second upstanding walls 370, 371 which form stoppers that only allow a certain degree of rotation of the first part 310 relative to the second part 350 when the bracket member 300 is coupled to the first and second support members 2110, 2150 as described herein. In particular, and as seen in FIG. 7, when the first support member 2110 is disposed within the first channel 318, the first part 310 of the bracket member 300 can only be rotated so far until the first support member 2110 abuts against one of the upstanding walls 370, 371. Thus, the upstanding walls 370, 371 may permit relative rotation between the first and second support members 2110, 2150 to adjust the angle within a range of 60° to 120° and prevent relative rotation of the first and second support members 2110, 2150 outside of the range.

As seen in FIGS. 1 and 4, the overhead grid assembly 100, 2100 comprises a plurality of the bracket members 300. In particular, there is one of the bracket members 300 located at each node or each location where one of the first support members 110, 2110 intersects one of the second support members 150, 2150. Thus, the bracket members 300 ensure that a rigid coupling is achieved between the first and second support members 110, 150, 2110, 2150 regardless of the orientation at which the first support members 110, 2110 are positioned relative to the second support members 150, 2150.

Figure 11:
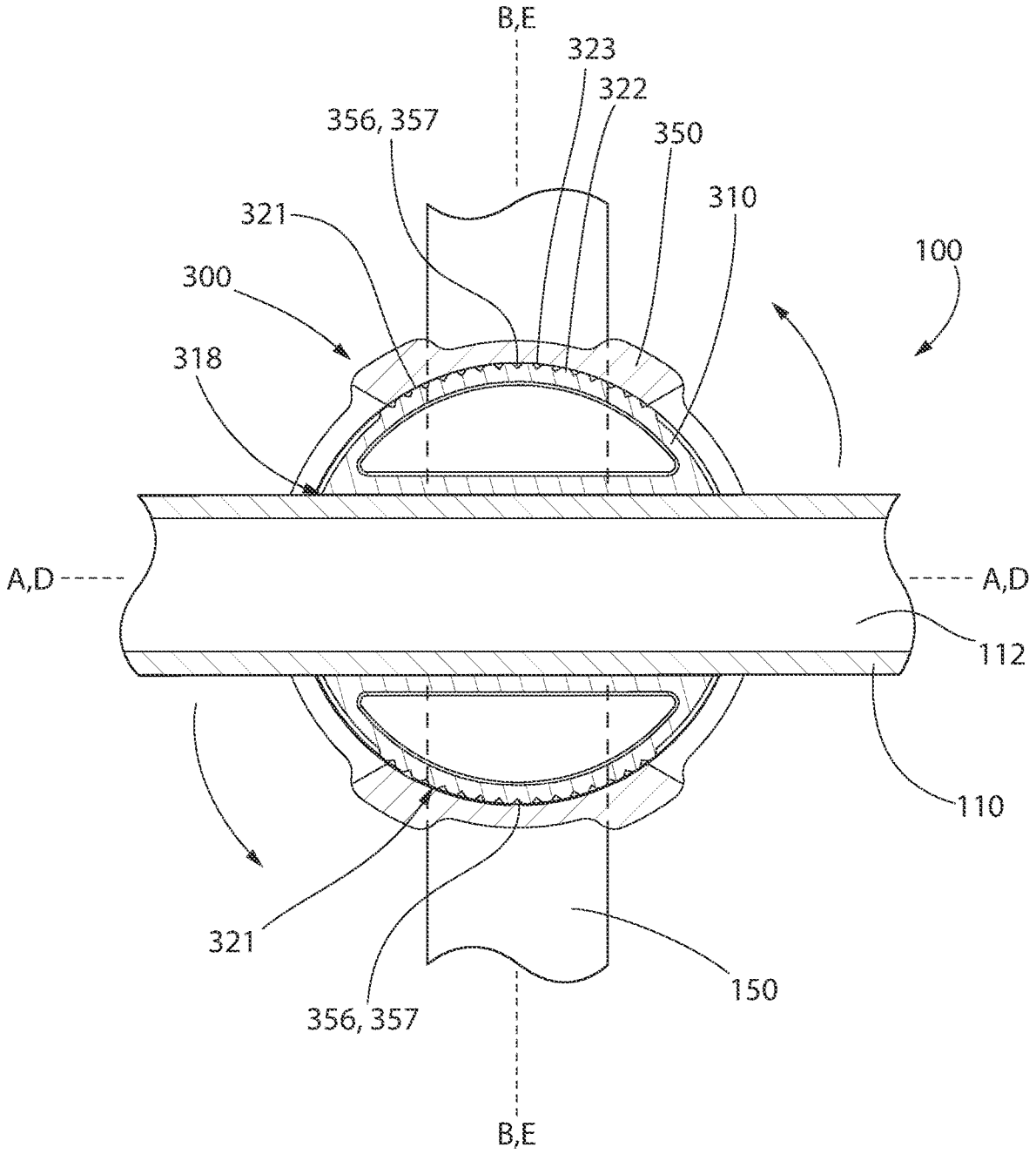
FIG. 11 is a cross-sectional view taken along line XI-XI of FIG. 6.
Figure 12:
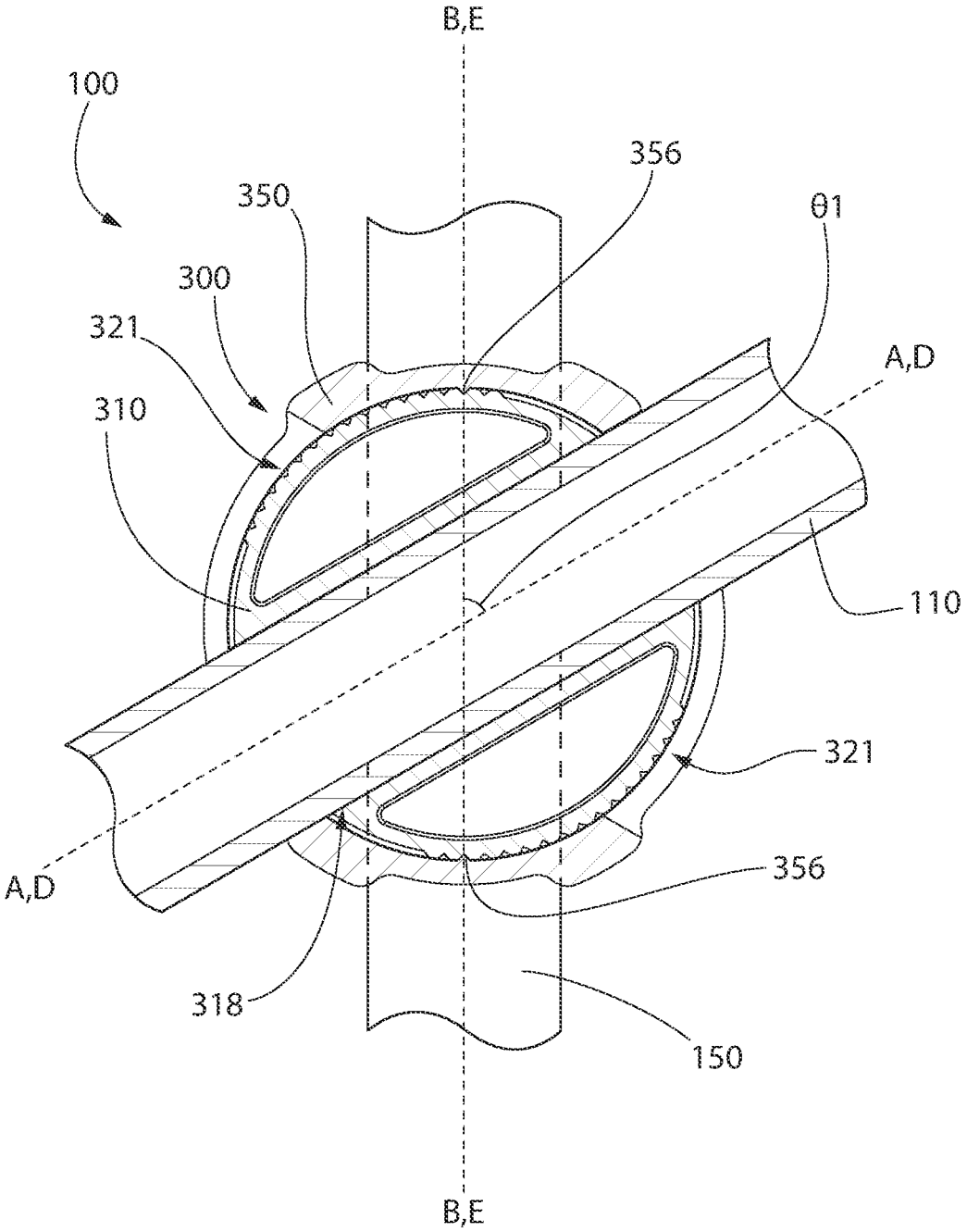
FIG. 12 is a cross-sectional view taken along line XII-XII of FIG. 7.

FIGS. 11 and 12 are cross-sectional views taken along the bracket members 300 in FIGS. 6 and 7, illustrating the adjustability of the bracket members 300 to enable the bracket members 300 to accommodate the first and second support members 110, 150, 2110, 2150 in different relative orientations/angles. Although FIG. 11 is a cross-section of the overhead grid assembly 100 and FIG. 12 is a cross-section of the overhead grid assembly 2100, in FIGS. 11 and 12 the numbering for the overhead grid assembly 100 is being used along with the first and second support members 110, 150 to avoid confusion. In particular, the same numbering is being used in FIGS. 11 and 12 for easy of understanding and clarity.

FIG. 11 illustrates the bracket member 300 coupled to the overhead grid assembly 100 whereby the first support member 110 nests within the first channel 318 and the second support member 150 nests within the second channel (the second channel is not visible in this view and is therefore not labeled, although it should be readily understood from the prior description and drawings). In FIG. 11, the first longitudinal axis A-A of the first support member 110 is perpendicular to the second longitudinal axis B-B of the second support member 150. Similarly, and because the first and second support members 110, 150 are nesting within the first and second channels 318, 360, the first channel axis D-D is perpendicular to the second channel axis E-E.

Moreover, as shown in FIG. 11, the second engagement feature 356 (i.e., the protuberance 357) protruding from the inner surface 354 of the second part 350 of the bracket member 300 mates with the first engagement feature 321 located on the outer surface 315, 317 of the first part 310 of the bracket assembly 300 (i.e., the protuberance 357 nests within one of the grooves 323 between two of the teeth 322 of the first engagement feature 321). In order to rotate the first part 310 relative to the second part 350, sufficient relative force must be applied onto the first part 310 relative to the second part 350 to allow the protuberance of the second engagement feature 356 to move past the teeth of the first engagement feature 321. Thus, it is unlikely that the first part 310 will rotate relative to the second part 350 accidentally without intentional user force being applied onto the first part 310 relative to the second part 350.

FIG. 12 illustrates the over head grid assembly 100 with the first part 310 of the bracket member 300 having been rotated approximately 30° relative to the second part 350 of the bracket member 300. As a result, the first longitudinal axis A-A of the first support member 110 is oriented at an oblique angle Θ1 (e.g., 60°) relative to the second longitudinal axis B-B of the second support member 150. Similarly, the first channel axis D-D is also oriented at the same oblique angle Θ1 (e.g., 60°) relative to the second channel axis E-E. Of course, the exact degree of the angle Θ1 may be any angle between 60° and 120° in increments of 5° in some embodiments. In other embodiments, the angle Θ1 may fall in a range of 30° to 150° and the increments may be smaller (for example 1°, with the increments being determined by the configurations of the first and second engagement features 321, 356).

Referring to FIGS. 13-16, an alternative embodiment of a bracket member 400 will be described. The bracket member 400 is illustrated being used with the first and second support members 110, 150 of the overhead grid assembly 100 in FIG. 13, and the bracket member 400 is illustrated in isolation in FIGS. 14-16. The bracket member 400 comprises a first part 410 and a second part 450 that are configured to be rotatable relative to one another when the bracket member 400 is assembled, much like the bracket member 300 described above. However, the structure of the bracket member 400 is somewhat different than the structure of the bracket member 300 previously described, and thus these differences in structure will be described herein below.

Figure 13:
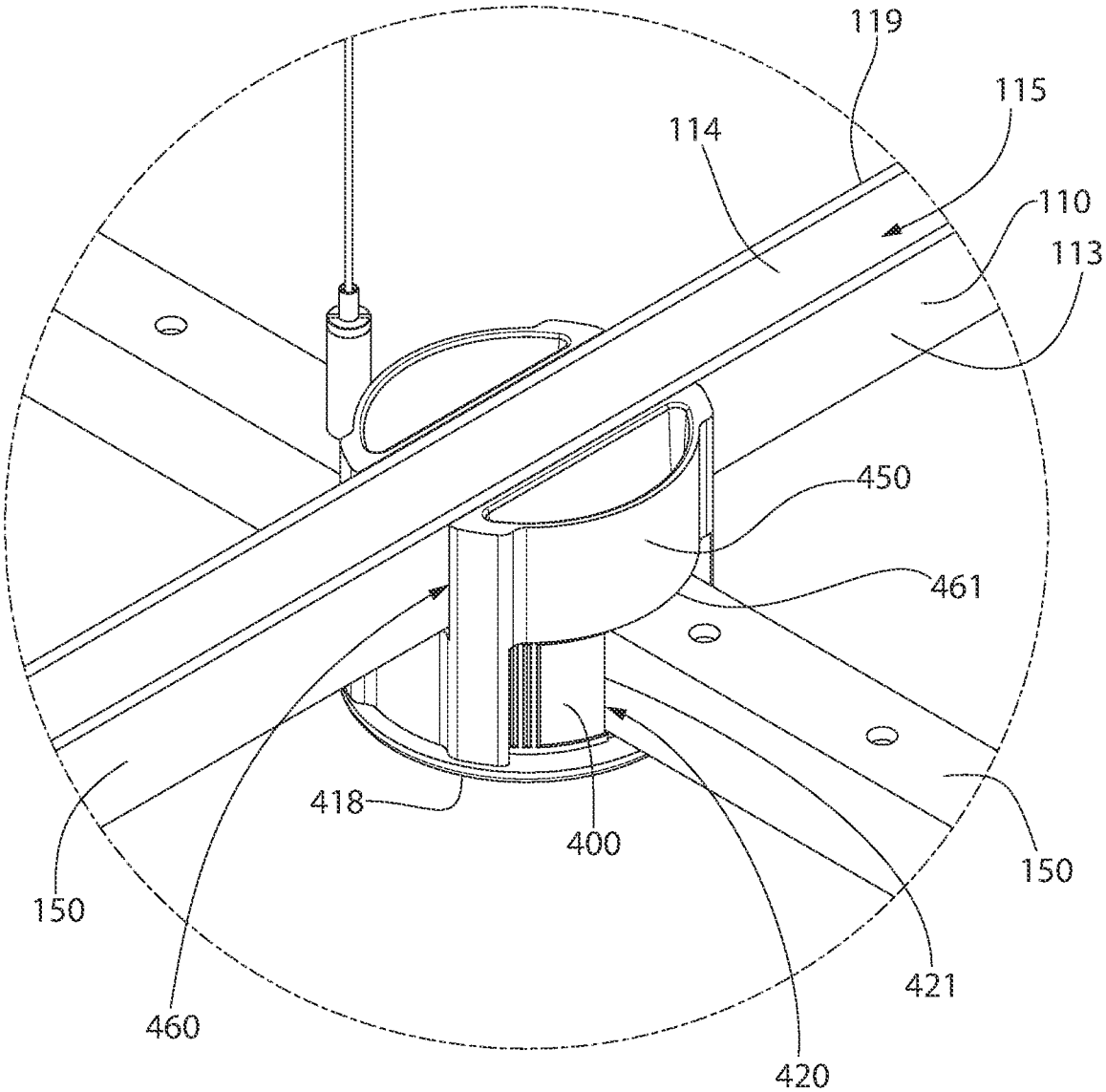
FIG. 13 is the close-up view of FIG. 6 whereby a bracket assembly in accordance with a second embodiment of the present invention is shown.
Figure 14:
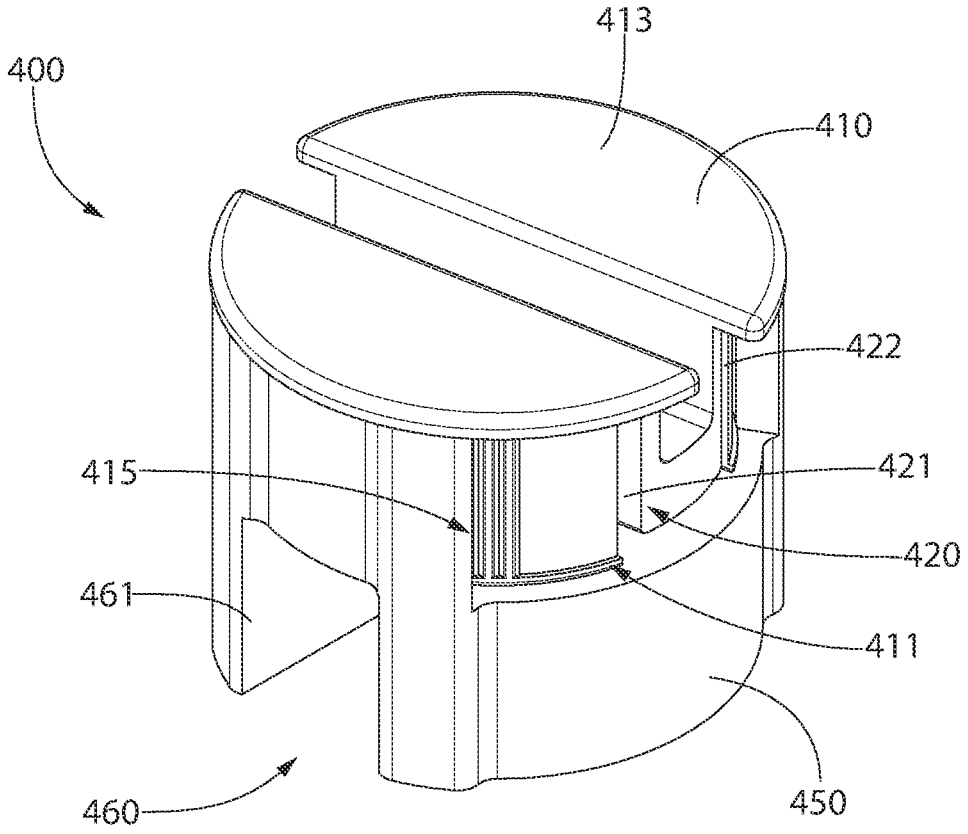
FIG. 14 is a perspective view of the bracket assembly of FIG. 13.
Figure 15:
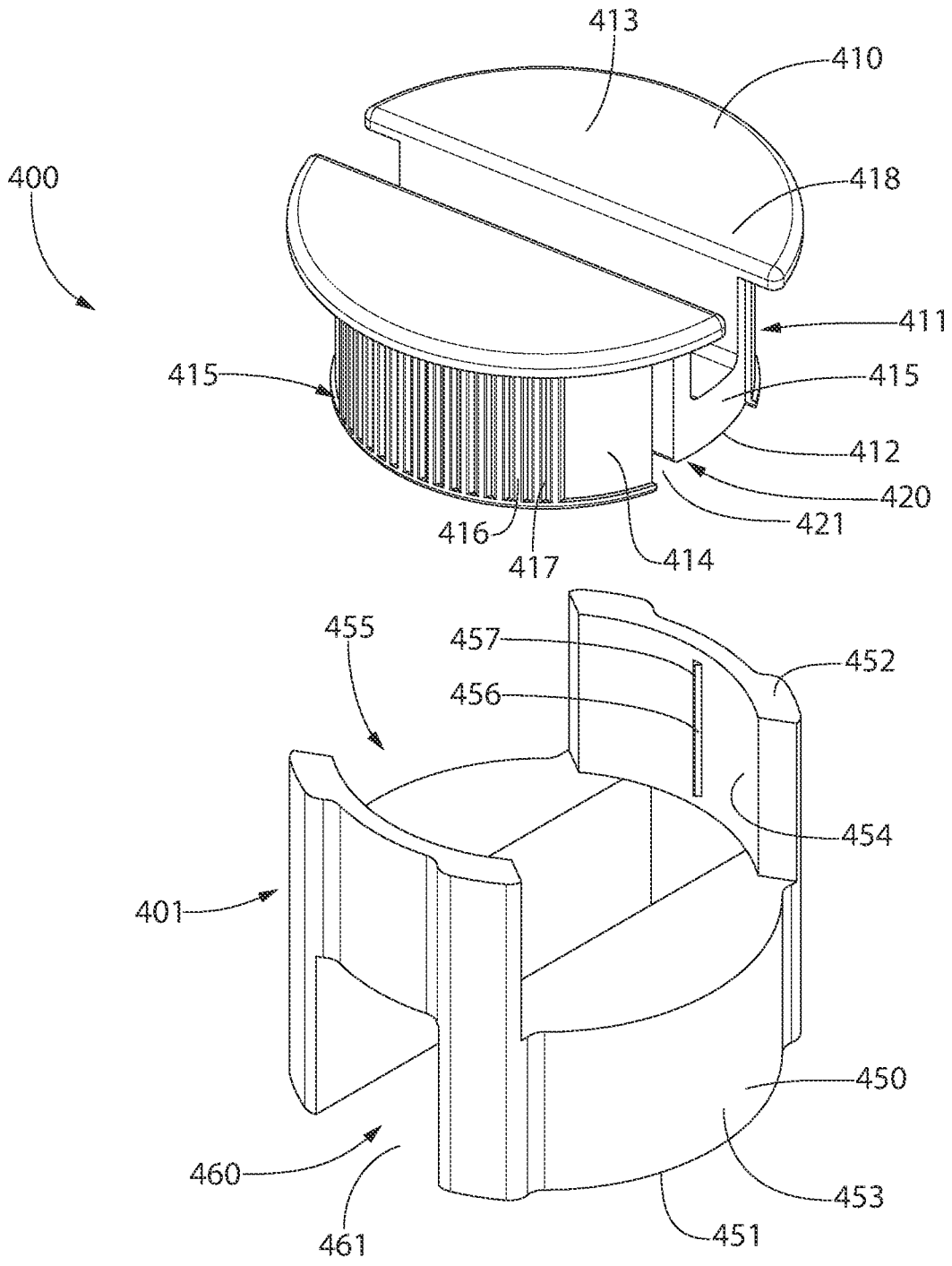
FIG. 15 is a top perspective view of the bracket assembly of FIG. 13 in a disassembled configuration.
Figure 16:
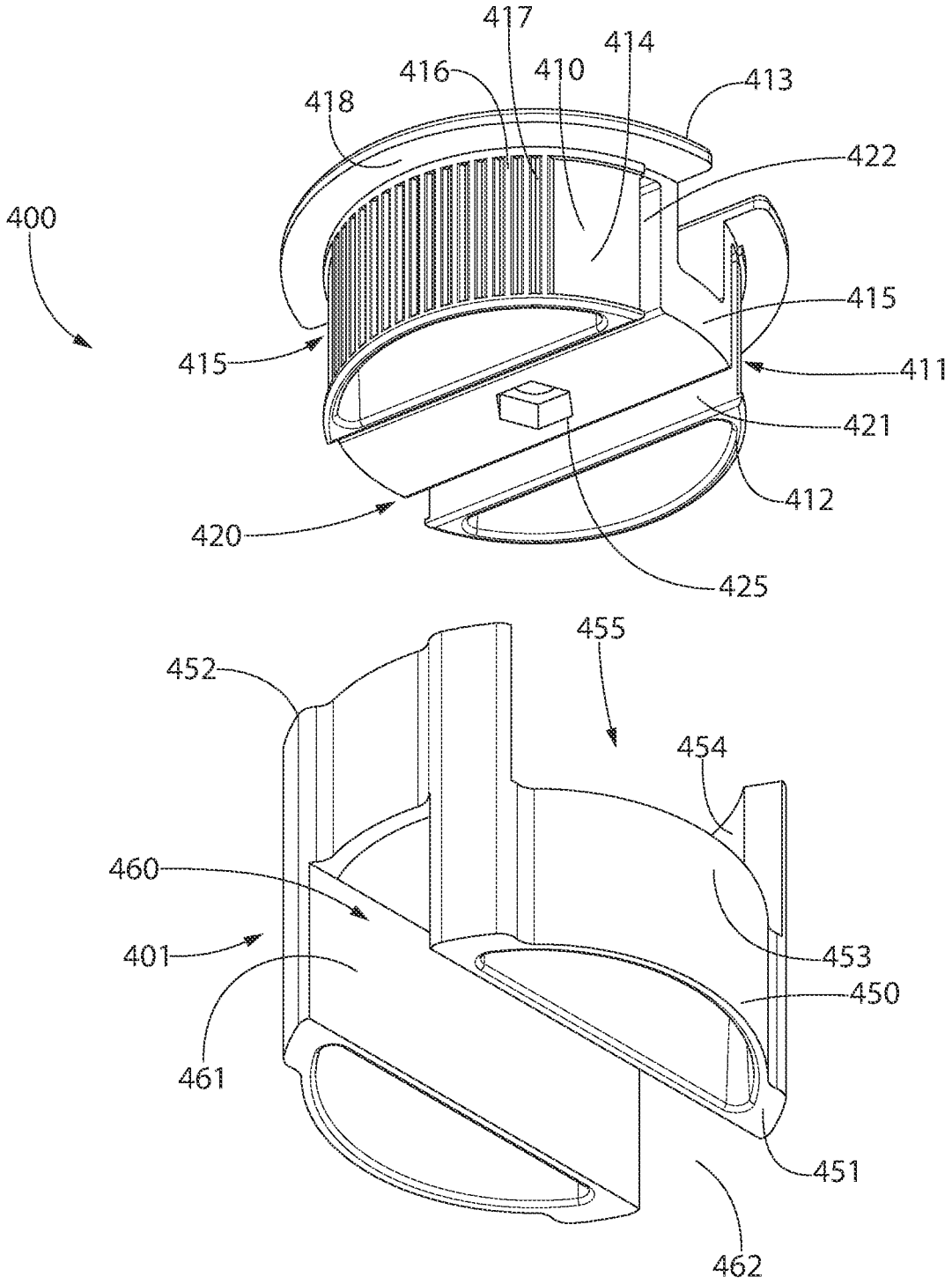
FIG. 16 is a bottom perspective view of the bracket assembly of FIG. 13 in the disassembled configuration.

The first part 410 of the bracket member 400 comprises a cylindrical body 411 comprising a bottom end 412, a top end 413, and an outer surface 414. The outer surface comprises a first engagement feature 415. In the exemplified embodiment, the first engagement feature 415 comprises a plurality of teeth 416 and a plurality of grooves 417 located between adjacent ones of the teeth 416. Moreover, the cylindrical body 411 of the first part 410 defines a first channel 420 that is configured to receive a portion of the first support member 110 of the overhead grid assembly 100 as shown in FIG. 13.

In this embodiment, the first channel 420 comprises a first notch 421 extending upwardly from the bottom end 412 towards but not all the way to the top end 413 and a second notch 422 extending upwardly from the bottom end 412 towards but not all the way to the top end 413. Each of the first and second notches 421, 422 are open along the bottom end 412 of the cylindrical body 411 and along two opposing sides of the cylindrical body 411 so that the sidewalls 113, 114 of the first support member 110 can be received therein. As best seen in FIG. 13, the bracket assembly 400 is coupled to the first support member 110 such that the first sidewall 113 of the first support member 110 nests within the first notch 421 of the first channel 420 and the second sidewall 114 of the first support member 110 nests within the second notch 422 of the first channel 420. A central portion 415 of the cylindrical body 411 nests within the cavity 115 of the first support member 110. Moreover, in this embodiment a top portion 418 of the cylindrical body 411 covers the top edge 119 of the sidewalls 113, 114 of the first support member 110.

Figure 21:
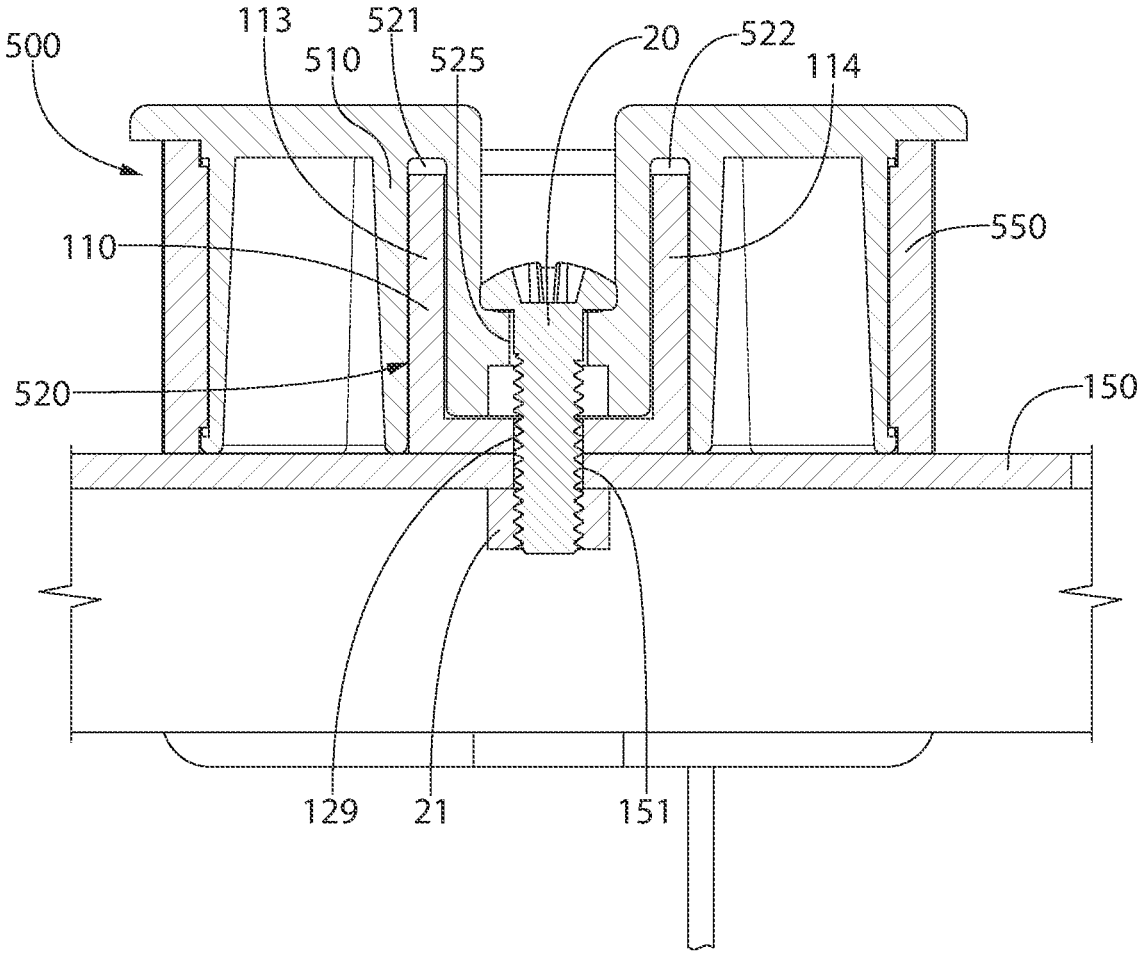
FIG. 21 is a cross-sectional view taken along line XXI-XXI of FIG. 17.

The first part 410 comprises a fastener receiving opening 425 on the bottom end 412 thereof. In particular, the fastener receiving opening 425 is located on the bottom end 412 of the cylindrical body 411 along the central portion 415 thereof. The fastener receiving opening 425 is configured to receive a fastener (nut, bolt, screw, etc.) to couple the bracket member 400 to the first and/or second support members 110, 150. FIG. 21 shows this concept with regard to another embodiment to described later, but the description of FIG. 21 is applicable here as well.

The second part 450 of the bracket member 400 is identical to the second part 350 of the bracket member 300 described above. Thus, while a brief description of the features of the second part 450 of the bracket member 400 are provided herein, it should be appreciated that a more detailed description is available above with regard to the second part 350 of the bracket member 300.

The second part 450 of the bracket member 400 comprises a ring-shaped body 401 having a bottom end 451, a top end 452, an outer surface 453 and an inner surface 454. The inner surface 454 defines a cavity 455 within which a portion of the first part 410 nests when the bracket member 400 is assembled. Furthermore, the second part 450 comprises a second engagement feature 456 protruding from the inner surface 454 towards the cavity 455. The second engagement feature 456 is an elongated protuberance in the exemplified embodiment. The second part 450 also comprises a second channel 460 that is defined by a first opening 461, a second opening 462, and a portion of the cavity 455 which extends between the first and second openings 461, 462. When the bracket member 400 is coupled to the first and second support members 110, 150, a portion of the second support member 150 nests within the second channel 460 defined by the second part 450 of the bracket member 400. The second support member 150 then protrudes through the first and second openings 461, 462 of the second channel 460, as best seen in FIG. 13.

As with the bracket member 300, the bracket member 400 is also alterable such that the first part 410 is configured to rotate relative to the second part 450 so that the bracket member 400 can be used with the first and second support members 110, 150 at different orientations/angles relative to each other. The first and second engagement features 415, 456 mate with each other to prevent the first part 410 from freely rotating relative to the second part 450. However, a user can apply a rotational force onto the first part 410 relative to the second part 450 to cause the first part 410 to rotate relative to the second part 450 as has been described herein. The degree of rotation and the angles that the first and second channels 420, 460 and also the first and second support members 110, 150 can be moved along is the same as that which was described above. Additional details of the bracket member 300 are applicable to the bracket member 400 as should be appreciated by persons of ordinary skill in the art.

Referring to FIGS. 17-21, an alternative embodiment of a bracket member 500 will be described. The bracket member 500 is illustrated being used with the first and second support members 110, 150 of the overhead grid assembly 100 in FIG. 17, and the bracket member 500 is illustrated in isolation in FIGS. 18-20. The bracket member 500 comprises a first part 510 and a second part 550 that are configured to be rotatable relative to one another when the bracket member 500 is assembled, much like the bracket members 300, 400 described above. However, the structure of the bracket member 500 is somewhat different than the structure of the bracket members 300, 400 previously described, and thus these differences in structure will be described herein below.

In this embodiment, the first part 510 of the bracket member 500 is identical to the first part 410 of the bracket member 400 described above. Thus, the first part 510 of the bracket member 500 comprises a cylindrical body 511 having an outer surface 514. A first engagement feature 515 (i.e., the teeth and grooves as described above) is formed on the outer surface 514 of the cylindrical body 511. Furthermore, the first part 510 of the bracket member 510 comprises a first channel 520 which is formed by a first notch 521 and a second notch 522. Because the first part 510 of the bracket member 500 is identical to the first part 410 of the bracket member 400, additional details of the first part 510 of the bracket member 500 will not be provided here in the interest of brevity.

Figure 17:
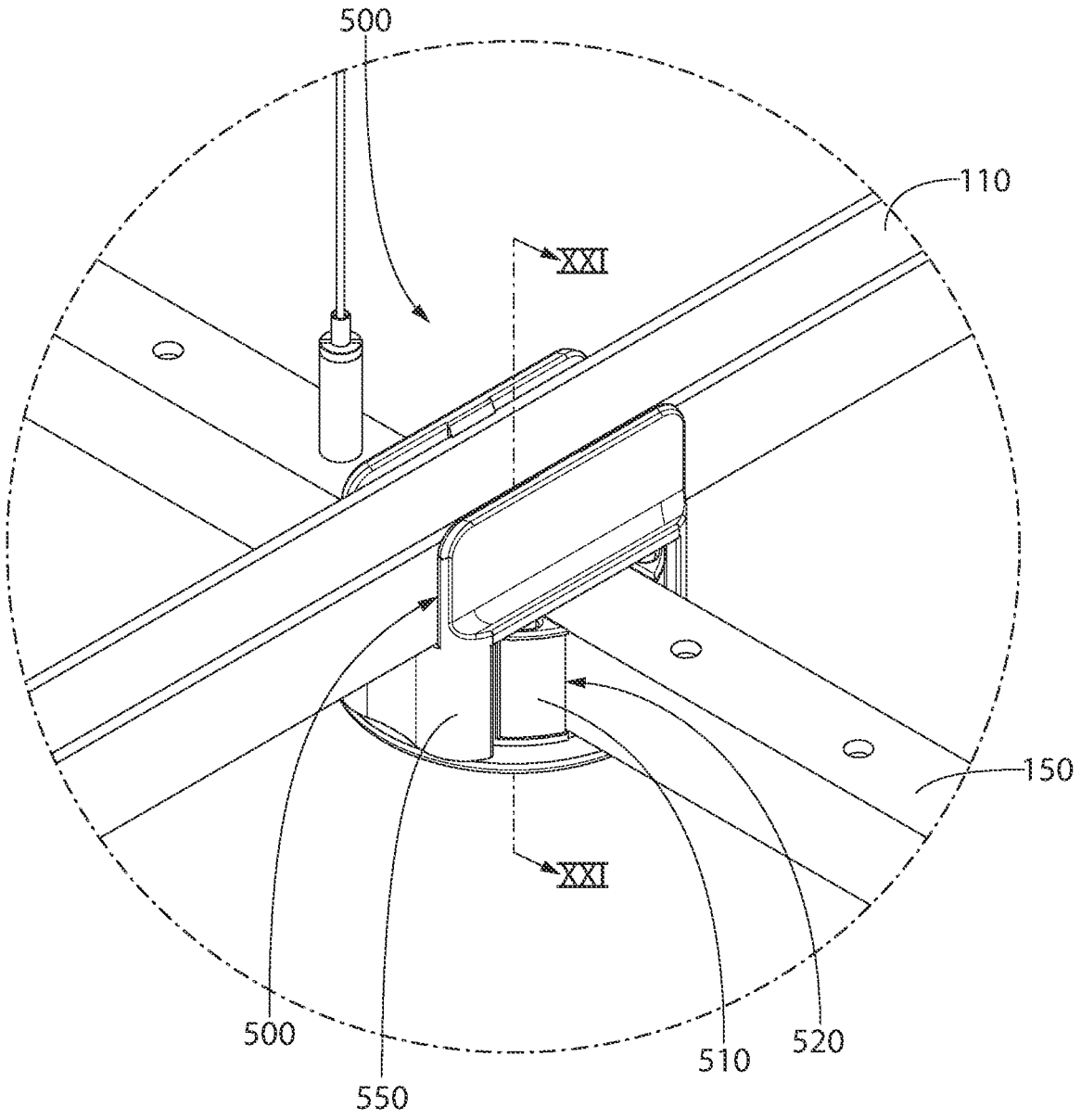
FIG. 17 is the close-up view of FIG. 6 whereby a bracket assembly in accordance with a third embodiment of the present invention is shown.
Figure 18:
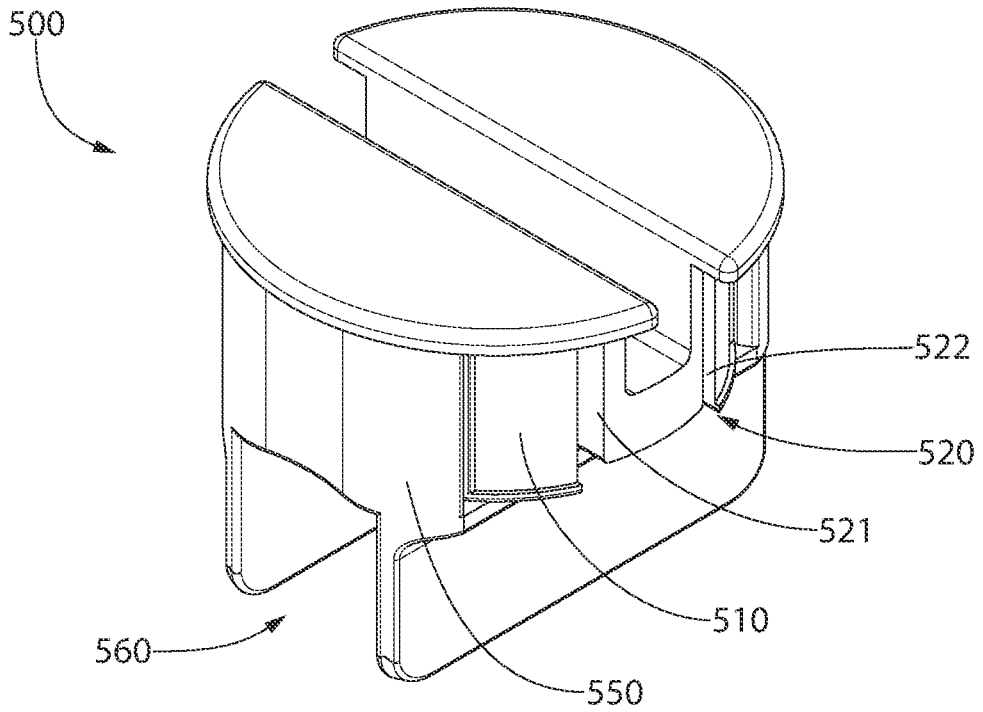
FIG. 18 is a perspective view of the bracket assembly of FIG. 17.
Figure 19:
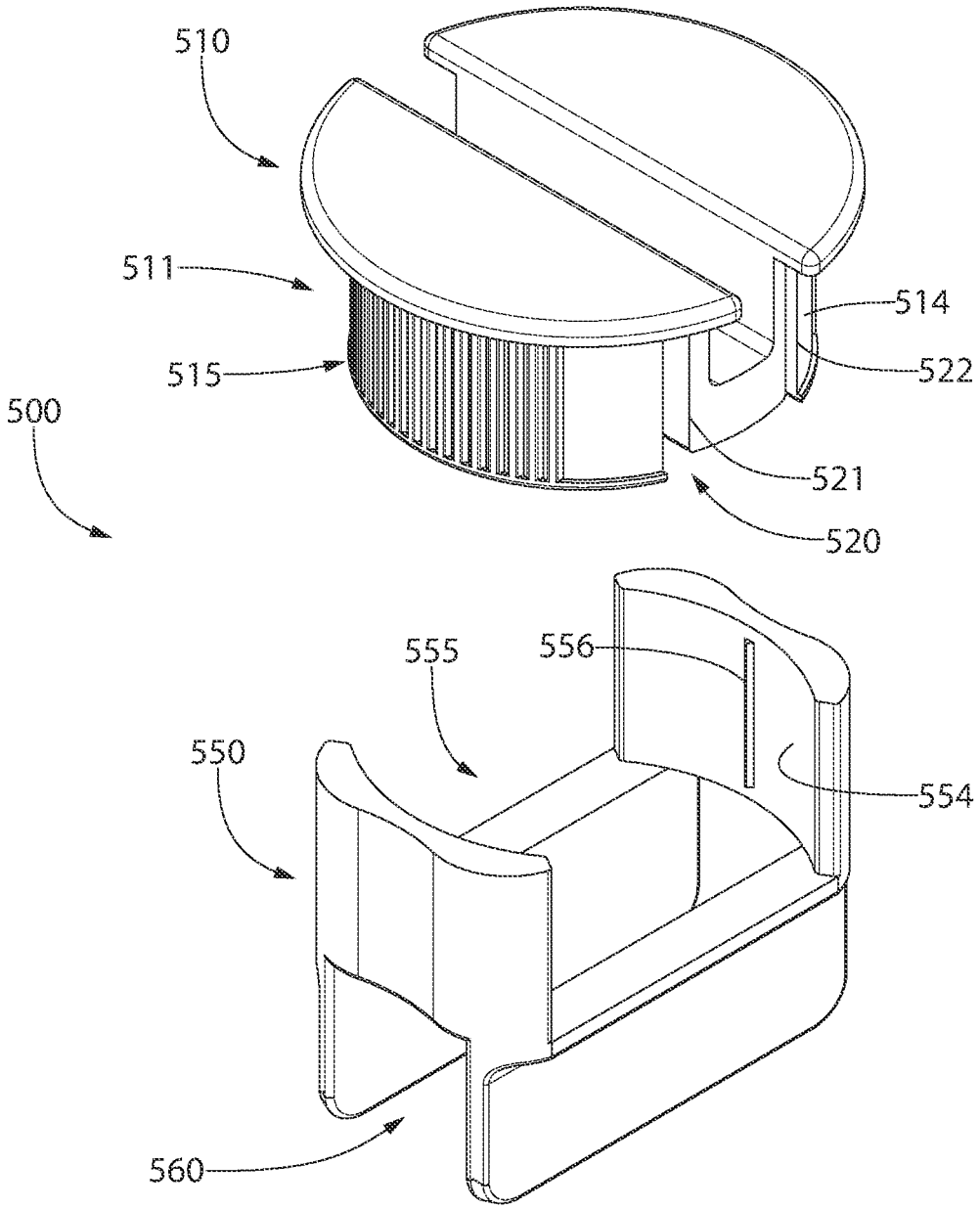
FIG. 19 is a top perspective view of the bracket assembly of FIG. 17 in a disassembled configuration.

The second part 550 is very similar to the second part 450 of the bracket member 400, except the second part 550 of the bracket member 500 has more of a rectangular shape rather than being fully rounded as with the second part 450 of the bracket member 400. The second part 550 comprises an inner surface 554 that defines a cavity 555 within which a portion of the first part 510 nests when the bracket member 500 is assembled. Although the exterior shape of the second part 550 is more of a rectangle than a circle, the inner surface 554 remains arcuate so that the first part 510 can still rotate relative to the second part 550 as has been described herein with regard to the previously described embodiments. A second engagement feature 456 is located on and projects from the inner surface 554 as with the embodiments previously described. Furthermore, the second part 550 comprises a second channel 560 configured to receive a portion of the second support member 150 as shown in FIG. 17. That is, a portion of the second support member 150 nests within the second channel 560, and then the second support member 150 protrudes from the ends of the second channel 560.

The first and second support members 110, 150 may be rotated relative to one another so that they are not perpendicular as shown in FIG. 17. Thus, the first and second support members 110, 150 may be positioned at an angle between 60° and 120° relative to each other. Moreover, the first part 510 of the bracket member 500 is configured to be rotated relative to the second part 550 of the bracket member 500 so that the angle between the first and second channels 520, 560 of the bracket member 500 matches the angle between the first and second support members 110, 150. This ensures that the first support member 110 nests within the first channel 520 and the second support member 150 nests within the second channel 560 regardless of the angle at which the first and second support members 150 are positioned relative to each other.

Figure 20:
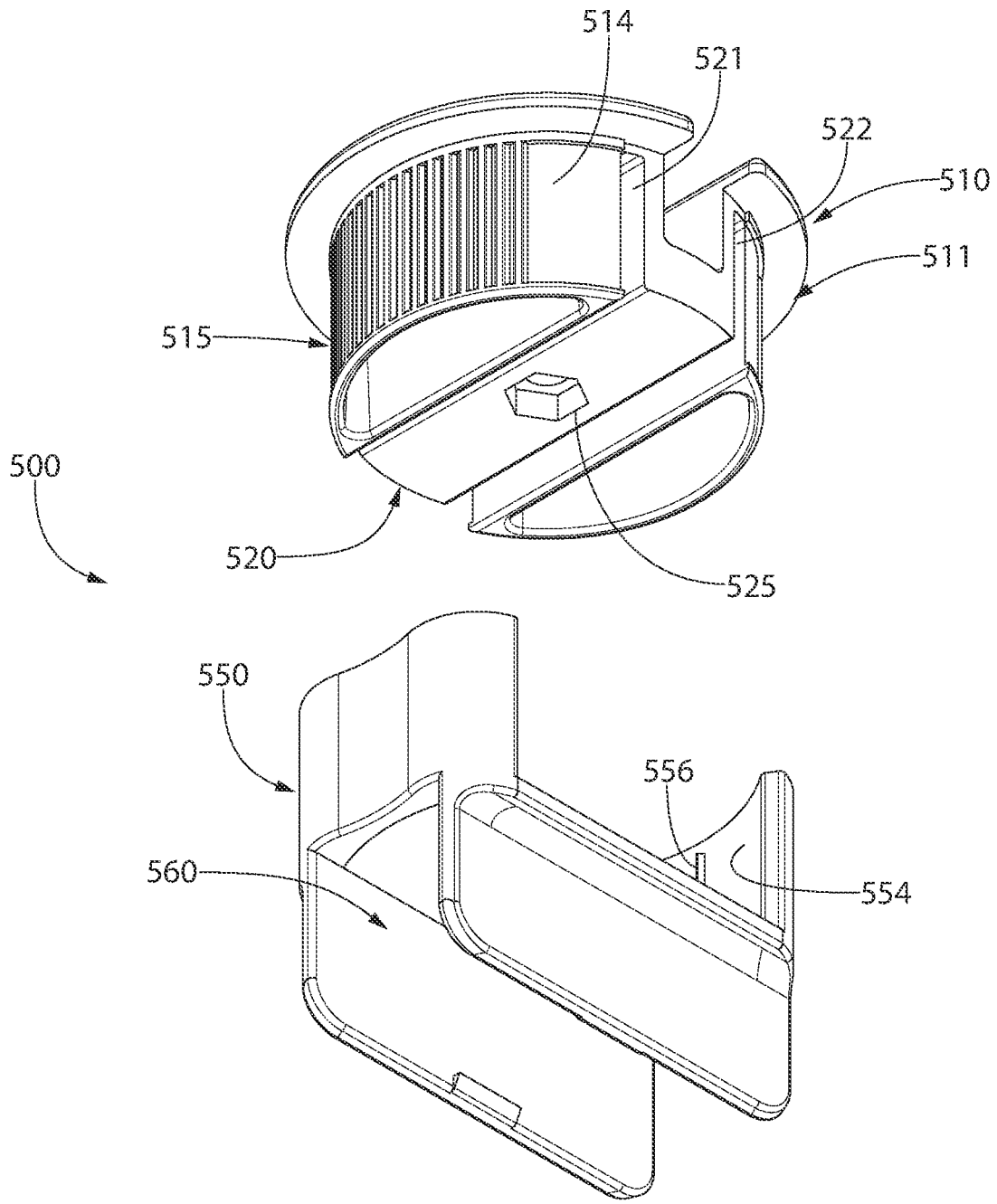
FIG. 20 is a bottom perspective view of the bracket assembly of FIG. 17 in a disassembled configuration.

Referring to FIGS. 20 and 21, the first part 510 of the bracket member 500 comprises a fastener receiving opening 525 that is configured to receive a fastener 20 that is used to couple the first and second support members 110, 150 together. Thus, the fastener 20 not only couples the first and second support members 110, 150 to one another, but also couples the bracket member 500 to the first and second support members 110, 150. In particular, and as shown in FIG. 21, the fastener 20 extends through one of the holes 151 of the second support member 150 and one of the holes 129 of the first support member 110 which is aligned with the hole 151 of the second support member 150. Furthermore, the fastener 20 extends through the opening 525 in the first part 510 of the bracket member 500. Thus, the fastener 20 securely couples the bracket member 500, the first support member 110, and the second support member 150 together. Although in the exemplified embodiment, the fastener 20 extends downwardly through the fastener receiving opening 525 and engages with a nut 21 positioned within the second support member 150, in other embodiments the nut 21 may be positioned within the opening 525 of the bracket member 500, or other configurations for the fastener 20 may be used. When the fastener 20 is secured, the geometry configuration prescribed by the detent protuberance of the bracket member 500 is fixed. That is, the first part 510 of the bracket member 500 may be prevented from rotating relative to the second part 520 of the bracket member 500 when the fastener 20 is secured as shown in FIG. 21. Stated another way, once the fastener 20 is secured, the first and second parts 510, 520 may be locked relative to one another such that they are prevented from rotating (which also prevents the first and second support members 110, 150 from rotating relative to one another).

Finally, referring to FIGS. 22-25, another alternative embodiment of a bracket member 600 will be described. The bracket member 600 is illustrated being used with the first and second support members 110, 150 of the overhead grid assembly 100 in FIG. 22, and the bracket member 600 is illustrated in isolation in FIGS. 23-25. The bracket member 600 comprises a first part 610 and a second part 650 that are configured to be rotatable relative to one another when the bracket member 600 is assembled, much like the bracket members 300, 400, 500 described above. However, the structure of the bracket member 600 is somewhat different than the structure of the bracket members 300, 400, 500 previously described, and thus these differences in structure will be described herein below.

The first part 610 of the bracket member 600 comprises a top portion 611 and an annular, ring-like sidewall 612 extending downwardly from the top portion 612 to a distal end 613. The sidewall 612 comprises an inner surface 614 that surrounds a cavity 615 and an outer surface 616 opposite the inner surface 614. There is an opening into the cavity 615 at the distal end 613 of the sidewall 612. The opposite end of the cavity 615 is closed by the top portion 611.

The first part 610 comprises a pair of parallel interior walls 616, 617 extending downwardly from the top portion 611 in the same direction as the sidewall 612. The pair of parallel interior walls 616, 617 are located within the cavity 615 and divide the cavity 615 into a first cavity portion and a second cavity portion. There is a fastener receiving opening 618 formed at the distal ends of the parallel interior walls 616, 617 for receiving a fastener to couple the bracket member 600 to the first and/or second support members 110, 150 as has been described above and illustrated in FIG. 21.

Figure 22:
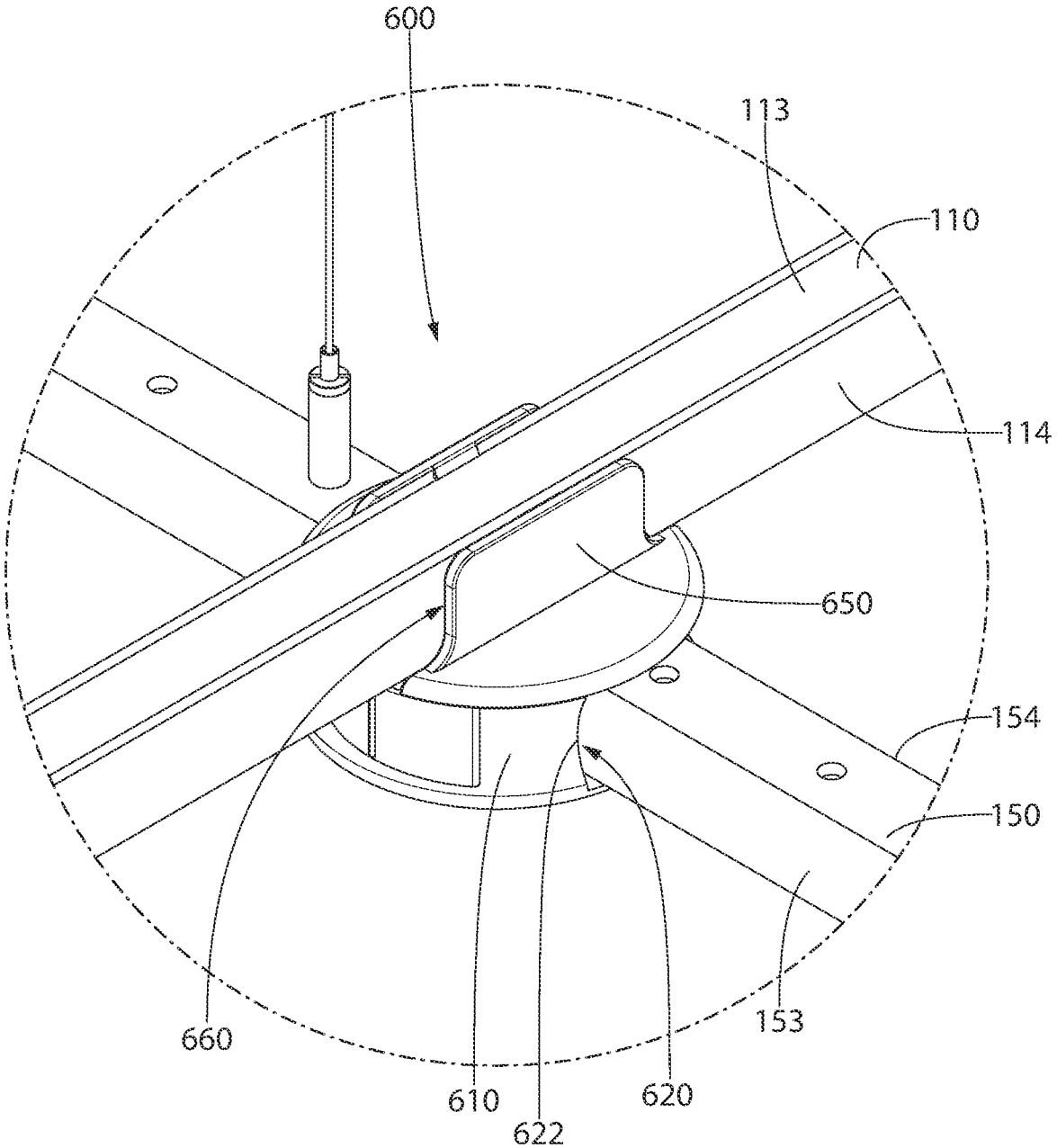
FIG. 22 is the close-up view of FIG. 6 whereby a bracket assembly in accordance with a fourth embodiment of the present invention is shown.
Figure 23:
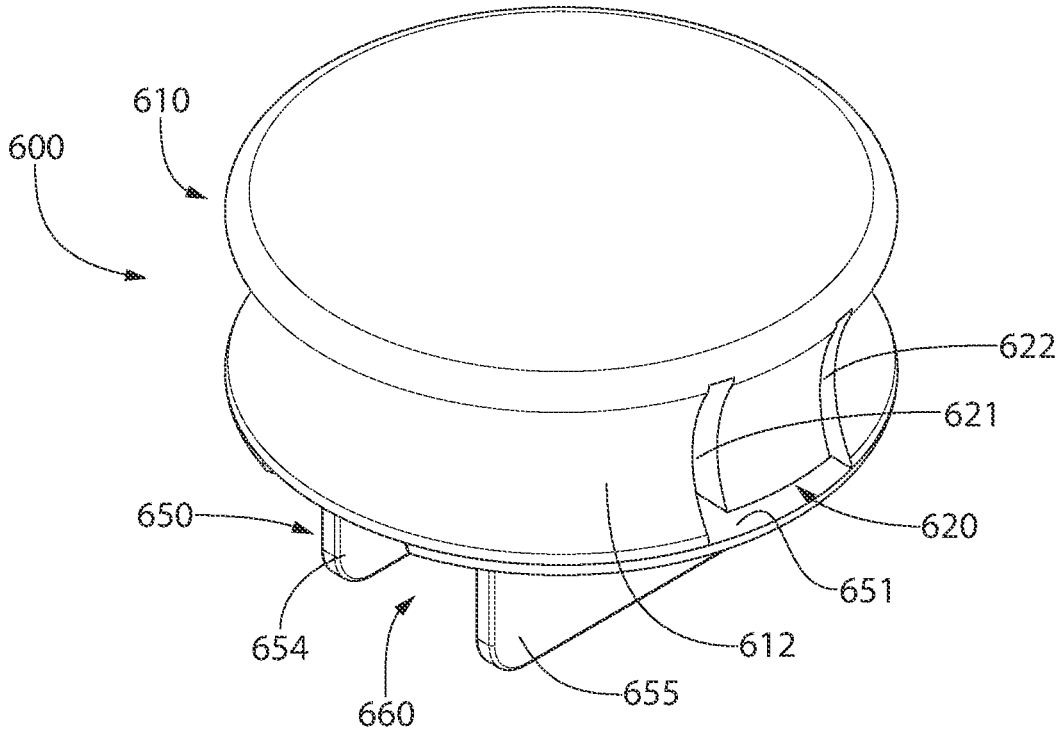
FIG. 23 is a perspective view of the bracket assembly of FIG. 22.
Figure 24:
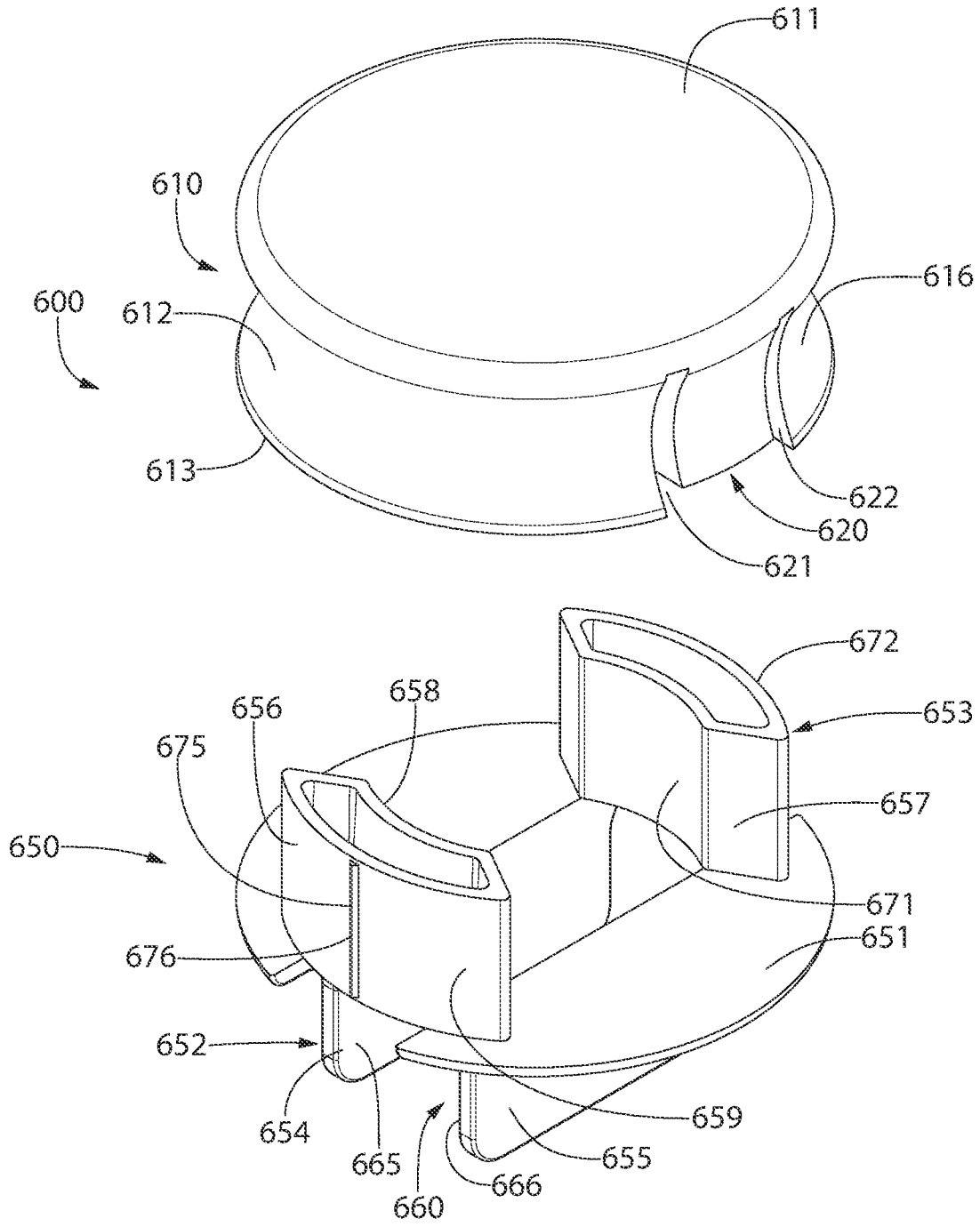
FIG. 24 is a top perspective view of the bracket assembly of FIG. 22 in a disassembled configuration.
Figure 25:
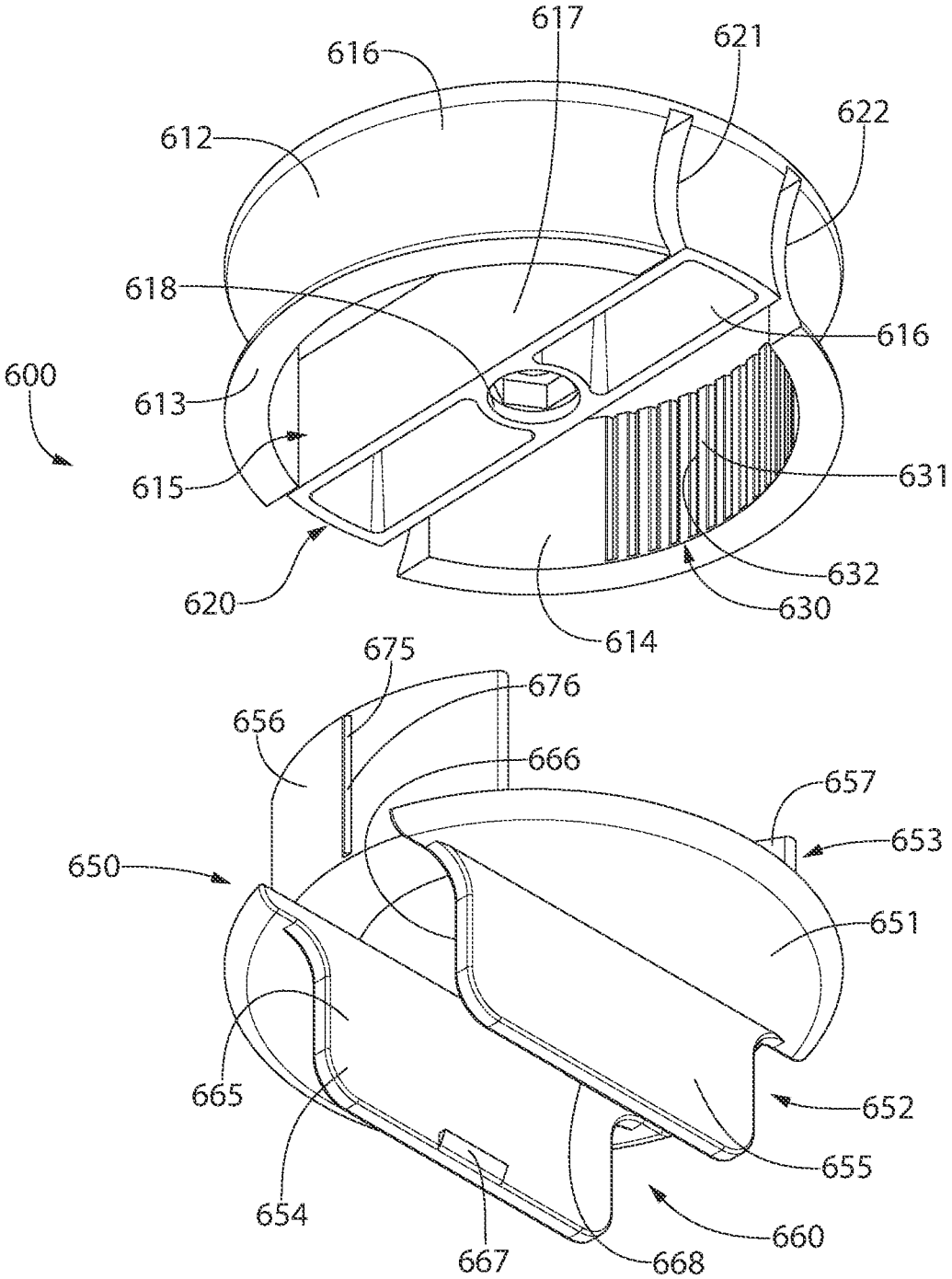
FIG. 25 is a bottom perspective view of the bracket assembly of FIG. 22 in the disassembled configuration.

The first part 610 comprises a first channel 620 for receiving a portion of the first support member 110 in a similar manner to that which has been described above. In particular, the first channel 620 comprises a first notch 621 that extends upwardly along the sidewall 612 from the distal end 613 towards (but not to) the top portion 611 and a second notch 622 that extends upwardly along the sidewall 612 from the distal end 613 towards (but not to) the top portion 611. As best seen in FIG. 22, the first sidewall 113 of the first support member 110 nests within the first notch 621 and the second sidewall 114 of the first support member 110 nests within the second notch 621 when the bracket member 600 is coupled to the first support member 110.

In this embodiment, there is a first engagement feature 630 located on the inner surface 614 of the sidewall 612 of the first part 610. In particular, the first engagement feature 630 comprises a plurality of teeth 631 and a plurality of grooves 632 that are arranged in an alternating manner. Thus, the first engagement feature 630 of the first part 610 of the first bracket member 600 is similar to the previously described first engagement features, except with regards to its location being on the inner surface 614 of the first part 610 whereas those previously described were located on the outer surface. The first engagement feature 630 interacts with an engagement feature on the second part 650 (described below and similar to the same features noted in the embodiments above) to prevent the first part 610 from freely rotating relative to the second part 650.

The second part 650 of the bracket member 600 comprises a base surface 651, a lower portion 652 extending downwardly from the base surface 651, and an upper portion 653 extending upwardly from the base surface 651. More specifically, the lower portion 652 comprises a first wall member 654 and a second wall member 655 that are spaced apart and that define a second channel 660. The first wall member 654 has an inner surface 665 and the second wall member 655 has an inner surface 666, with the inner surfaces 665, 666 of the first and second wall members 654, 655 facing each other. The second channel 660 is defined by the space between the inner surfaces 665, 666 of the first and second wall members 654, 655 of the lower portion 652. Furthermore, a first tab member 667 protrudes from the inner surface 665 of the first wall member 654 adjacent to the distal end thereof and a second tab member 668 protrudes from the inner surface 666 of the second wall member 655 adjacent to the distal end thereof. The first and second tab members 667, 668 form locking features that facilitate the coupling of the second part 650 of the bracket member 600 to the second support member 150. That is, the first and second tab members 667, 668 engage a distal surface of the first and second sidewalls 153, 154 of the second support member 150 when the second support member 150 is nesting within the second channel 660.

The upper portion 653 comprises a first upstanding wall 656 and a second upstanding wall 657 that are circumferentially spaced apart from each other. Furthermore, the first upstanding wall 656 comprises an inner surface 658 and an outer surface 659 and the second upstanding wall 657 comprises an inner surface 671 and an outer surface 672. The inner surfaces 658, 671 of the first and second upstanding walls 656, 657 are concave and the outer surfaces 659, 672 of the first and second upstanding walls 656, 657 are convex. The first and second upstanding walls 656, 657 form stoppers that prevent over-rotation of the first part 610 relative to the second part 650 as has been described above.

Furthermore, a second engagement feature 675 is located on the outer surfaces 659, 672 of each of the first and second upstanding walls 656, 657 (although the second engagement feature 675 is only depicted on the outer surface 659 of the first upstanding wall 656, it may also be located redundantly on the second upstanding wall 657). In the exemplified embodiment, the second engagement feature 675 comprises an elongated protuberance 676 that is configured to mate with the teeth 631 and grooves 632 of the first engagement feature 630 to prevent free rotation of the first part 610 relative to the second part 650 as has been described in detail herein.

When the bracket member 600 is assembled, the first and second upstanding walls 656, 657 of the second part 650 nest within the first and second portions of the cavity 615 of the first part 610 such that the outer surfaces 659, 672 of the first and second upstanding walls 656, 657 face the inner surface 614 of the sidewall 612 of the first part 610. Thus, the second engagement feature 675 faces and mates/interacts with the first engagement feature 630 to prevent free rotation of the second part 610 relative to the first part 650.

Once assembled, the bracket member 600 is configured to be coupled to the first and second support members 610, 650 as shown in FIG. 22. Specifically, the bracket member 600 is positioned so that the second support member 150 nests within the second channel 660 defined by the second part 650 of the bracket member 600 and the first support member 110 nests within the first channel 620 (and specifically the first and second notches 621, 622 thereof) defined by the first part 610 of the bracket member 600. As has been described in detail above, the first part 610 of the bracket member 600 is configured to be rotated about a rotational axis (which is also the longitudinal axis of the bracket member 600) so that the relative angle between the first and second channels 620, 660 matches the relative angle between the first and second support members 110, 150.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. An overhead grid assembly for a suspended ceiling system, the overhead grid assembly comprising:

a first support member comprising a first longitudinal axis;

a second support member comprising a second longitudinal axis;

a bracket member comprising a first part comprising a first channel and a second part comprising a second channel, wherein the bracket member is configured to be positioned so that a portion of the first support member nests within the first channel and a portion of the second support member nests within the second channel;

wherein the first and second parts of the bracket member are rotatable relative to one another to adjust an angle measured between the first and second longitudinal axes of the first and second support members; and wherein one of the first and second parts of the bracket member comprises a first engagement feature and the other one of the first and second parts of the bracket member comprises a second engagement feature that mates with the first engagement feature to prevent the first and second parts from freely rotating relative to one another.

2. The overhead grid assembly according to claim 1 wherein the first part comprises an inner surface that defines a cavity and the first engagement feature comprises a plurality of first teeth located on the inner surface of the first part, wherein the second part comprise an outer surface and the second engagement feature comprises a protuberance located on the outer surface of the second part, and wherein when the bracket member is assembled at least a portion of the second part nests within the cavity of the first part and the at least one protuberance of the second part engages the plurality of first teeth of the first part.

3. An overhead grid assembly for a suspended ceiling system, the overhead grid assembly comprising:

a first support member comprising a first longitudinal axis;

a second support member comprising a second longitudinal axis;

a bracket member comprising a first part comprising a first channel and a second part comprising a second channel, wherein the bracket member is configured to be positioned so that a portion of the first support member nests within the first channel and a portion of the second support member nests within the second channel;

wherein the first and second parts of the bracket member are rotatable relative to one another to adjust an angle measured between the first and second longitudinal axes of the first and second support members; and wherein the first and second support members are U-shaped and comprise a floor and first and second sidewalls extending from the floor, and wherein the first and second support members are configured to be positioned so that the floors of the first and second support members face each other and the first and second sidewalls of the first support member extend in an opposite direction than the first and second sidewalls of the second support member, and wherein the bracket assembly is configured to extend along portions of each of the first and second support members.

4. The overhead grid assembly according to claim 3 further comprising:

the first part of the bracket member comprising a bottom end, a top end, and the first channel, the first channel comprising a first notch and a second notch extending from the bottom end towards the top end, the first and second sidewalls of the first support member configured to nest within the first and second notches; and the second part comprising a bottom end, a top end, and the second channel formed into the bottom end, the second part configured to be positioned so that the floor and portions of the first and second sidewalls of the second support member nest within the second channel.

5. The overhead grid assembly according to claim 1 wherein the first channel comprises a first channel axis and the second channel comprises a second channel axis, and wherein the first and second parts of the bracket member are configured to rotate relative to one another to adjust an angle measured between the first and second channel axes within a range of at least 60° to 120°.

6. The overhead grid assembly according to claim 1 wherein the first support member comprises a plurality of holes and the second support member comprises a plurality of holes, and wherein the first and second support members are configured to be arranged so that one of the plurality of holes of the first support member is aligned with one of the plurality of holes of the second support member, and further comprising a fastener configured to extend through the one of the plurality of holes of the first support member and the one of the plurality of holes of the second support member to couple the first and second support members together, wherein the first part of the bracket assembly is disposed within a cavity of the second part of the bracket assembly, and further comprising a hole formed in the first part of the bracket assembly, and wherein the fastener is configured to extend into the hole of the first part to couple the bracket assembly to the first and second support members.

7. The overhead grid assembly according to claim 1 further comprising:

a plurality of the first support members configured to be arranged in a parallel configuration;

a plurality of the second support members configured to be arranged in a parallel configuration, each of the second support members configured to be oriented at the same angle relative to each of the first support members; and a plurality of the bracket members such that one of the bracket members is configured to be positioned at each location where one of the first support members intersects one of the second support members.

8. An overhead grid assembly for a suspended ceiling system, the overhead grid assembly comprising:

a first support member comprising a first longitudinal axis;

a second support member comprising a second longitudinal axis;

a bracket member comprising a first part comprising a first channel and a second part comprising a second channel, wherein the bracket member is configured to be positioned so that a portion of the first support member nests within the first channel and a portion of the second support member nests within the second channel;

wherein the first and second parts of the bracket member are rotatable relative to one another to adjust an angle measured between the first and second longitudinal axes of the first and second support members; and wherein the first support member is positioned at a first vertical height and the second support member is positioned at a second vertical height that is below the first vertical height so that the first and second longitudinal axes are located on different planes, wherein the second support member is coupled to a structural framework via one or more cables, and wherein the first support member rest atop of the second support member.

9. The overhead grid assembly according to claim 1 wherein the second part of the bracket member comprises a base surface, a lower portion extending downwardly from the base surface and comprising the second channel, and an upper portion extending upwardly from the base surface, the upper portion comprising a first upstanding wall and a second upstanding wall that are circumferentially spaced apart from each other, and wherein the first and second upstanding walls form stoppers that permit relative rotation between the first and second support members to adjust the angle within a range of 60° to 120° and prevent relative rotation of the first and second support members outside of the range.

10. An overhead grid assembly for a suspended ceiling system, the overhead grid assembly comprising:

a plurality of first support members configured to be arranged in a parallel configuration, each of the first support members comprising a first longitudinal axis;

a plurality of second support members configured to be arranged in a parallel configuration, each of the second support members comprising a second longitudinal axis, the first and second support members configured to be arranged so that the first longitudinal axes of each of the first support members is oriented at a first angle relative to the second longitudinal axes of each of the second support members;

a plurality of bracket members, each of the bracket members comprising a first channel comprising a first channel axis and a second channel comprising a second channel axis, wherein a portion of one of the first support members is configured to nest within the first channel and a portion of one of the second support members is configured to nest within the second channel;

wherein each of the bracket members is adjustable to modify a second angle measured between the first and second channel axes to match the second angle to the first angle; and wherein each of the plurality of second support members is coupled to a structural framework by a cable, and wherein each of the plurality of first support members rest atop of a top surface of one or more of the plurality of second support members without being directly coupled to the structural framework.

11. The overhead grid assembly according to claim 10 wherein each of the bracket members is configured to be coupled to one of the first support members and one of the second support members with one or more fasteners to maintain the first longitudinal axes of the first support members at the first angle relative to the second longitudinal axes of the second support members.

12. The overhead grid assembly according to claim 10 wherein each of the bracket members comprises:

a first part comprising the first channel;

a second part comprising the second channel; and wherein at least one of the first and second parts is rotatable relative to the other one of the first and second parts to adjust the second angle between the first and second channel axes.

13. The overhead grid assembly according to claim 12 wherein one of the first and second parts comprises a plurality of first teeth and the other one of the first and second parts comprises at least one protuberance that mates with the plurality of first teeth to prevent the first and second parts from freely rotating relative to one another.

14. The overhead grid assembly according to claim 13 wherein the first part comprises an inner surface that defines a cavity and the plurality of first teeth are located on the inner surface of the first part, wherein the second part comprise an outer surface and the at least one protuberance is located on the outer surface of the second part, and wherein when the bracket member is assembled the second part nests within the cavity of the first part and the at least one protuberance of the second part engages the plurality of first teeth of the first part.

15. The overhead grid assembly according to claim 10 wherein each of the first and second support members is a U-shaped member comprising a floor having an inner surface and an outer surface and first and second sidewalls extending from the floor, and wherein the first and second support members are configured to be positioned so that the outer surfaces of the floors of the first and second support members face each other and the first and second sidewalls of the first support members extend in an opposite direction than the first and second sidewalls of the second support members.

16. The overhead grid assembly according to claim 15 wherein each of the bracket members comprises:

a first part comprising a bottom end, a top end, and the first channel, the first channel comprising a first notch and a second notch extending from the bottom end towards the top end and configured to receive the first and second sidewalls of one of the first support members so that a portion of the first part positioned between the first and second notches nests within a cavity of the one of the first support members; and a second part comprising a bottom end, a top end, and the second channel formed into the bottom end, the second part positioned so that the floor and portions of the first and second sidewalls of the second support member nest within the second channel.

17. The overhead grid assembly according to claim 10 wherein each of the first support members is configured to be positioned at a first vertical height and each of the second support members is configured to be positioned at a second vertical height that is below the first vertical height so that the first and second longitudinal axes are located on different planes, the first support members being configured to rest atop of the second support members.

18. A ceiling system comprising:

an overhead grid assembly coupled to and hanging from a structural framework, the overhead grid assembly comprising:

a plurality of first support members arranged in a parallel configuration, each of the first support members comprising a first longitudinal axis;

a plurality of second support members arranged in a parallel configuration, each of the second support members comprising a second longitudinal axis, the first and second support members arranged so that the first longitudinal axes of each of the first support members is oriented at a first angle relative to the second longitudinal axes of each of the second support members; and a plurality of bracket members, each of the bracket members comprising a first channel comprising a first channel axis and a second channel comprising a second channel axis, wherein a portion of one of the first support members nests within the first channel and a portion of one of the second support members nests within the second channel;

wherein each of the bracket members is adjustable to modify a second angle measured between the first and second channel axes to match the second angle to the first angle; and a plurality of ceiling panels coupled to and hanging from the plurality of first and second support members.

* * * * *